US008708695B2

(12) United States Patent
Reese et al.

(10) Patent No.: US 8,708,695 B2
(45) Date of Patent: Apr. 29, 2014

(54) LIGHTER ASSEMBLY

(76) Inventors: Corbin E. Reese, Tempe, AZ (US); Nicholas R. Jungwirth, Scottsdale, AZ (US)

( * ) Notice: Subject to any disclaimer, the term of this patent is extended or adjusted under 35 U.S.C. 154(b) by 71 days.

(21) Appl. No.: 13/590,400
(22) Filed: Aug. 21, 2012

(65) Prior Publication Data

US 2014/0057220 A1 Feb. 27, 2014

(51) Int. Cl.

| | |
|---|---|
| ***F23D 14/28*** | (2006.01) |
| ***F23Q 1/06*** | (2006.01) |
| ***F23Q 2/00*** | (2006.01) |
| ***F23Q 2/36*** | (2006.01) |
| ***F23Q 2/20*** | (2006.01) |

(52) U.S. Cl.
CPC .. *F23Q 1/06* (2013.01); *F23Q 2/00* (2013.01); *F23Q 2/36* (2013.01); *F23Q 2/20* (2013.01)
USPC ..... 431/344; 431/129; 431/147; 431/150; 431/151

(58) Field of Classification Search
CPC ..... F23Q 1/06; F23Q 2/00; F23Q 2/36; F23Q 2/50
USPC ..... 431/344, 129, 147, 150, 151; 219/267, 219/270
See application file for complete search history.

(56) References Cited

U.S. PATENT DOCUMENTS 1,983,738 A 12/1934 Davis
4,850,854 A * 7/1989 Buck ..... 431/143

* cited by examiner

*Primary Examiner* — Alfred Basichas
(74) *Attorney, Agent, or Firm* — Parsons & Goltry; Michael W. Goltry; Robert A. Parsons

(57) ABSTRACT

A portable, handheld lighter assembly for lighting a lighting end of a rolled tobacco product, such as a cigarette or a cigar, includes an elongated body formed with opposed first and second channels formed on either side of a combustion zone and a stop formed in the elongated body. The combustion zone traverses the stop so as to couple the first channel in gaseous communication with the second channel. The stop restricts movement of a rolled tobacco product into the second channel from the first channel and restricts movement of a rolled tobacco product into the first channel from the second channel. A lighter is coupled to the elongated body and is for applying lighting heat to the combustion zone at the stop for lighting a lighting end of a rolled tobacco product applied against the stop in the combustion zone from the first channel or the second channel.

18 Claims, 6 Drawing Sheets

LIGHTER ASSEMBLY

FIELD OF THE INVENTION

The present invention relates to lighters and, more particularly, to hand held lighters that may be used to light rolled tobacco products, such as cigarettes or cigars.

BACKGROUND OF THE INVENTION

There are a variety of different types and styles of lighters that are typically referred to as cigarette lighters. Although these known lighters are effective for the lighting of rolled tobacco products, such as cigarettes and cigars, in calm conditions, they are not as effective for lighting such rolled tobacco products in inclement weather where wind and/or rain provide poor lighting conditions. Accordingly, there is a need in the art for an improved lighter construction useful for lighting rolled tobacco products, such as cigarettes and cigars, in inclement weather and which is adapted to stimulate the combustion and lighting of rolled tobacco products.

SUMMARY OF THE INVENTION

According to the principle of the invention, a portable, handheld lighter assembly for lighting a lighting end of a rolled tobacco product to be smoked, such as a cigarette or a cigar, includes an elongated body, a channel that extends through the elongated body from a first inlet of the elongated body to an opposed second inlet of the elongated body, and a stop, which is coupled to the elongated body and which is positioned in a combustion zone of the channel between the first and second inlets so as to define a first segment of the channel for the reception of a lighting end of a rolled tobacco product therein through the first inlet and an opposed second segment of the channel. The first segment of the channel extends from the first inlet to the combustion zone and the stop, and the second segment of the channel extends from the second inlet to the combustion zone and the stop. The stop is for interacting with a lighting end of a rolled tobacco product inserted into the first segment of the channel through the first inlet for restricting movement the rolled tobacco product into the second segment of the channel from the first segment of the channel. The combustion zone traverses the stop from the first segment of the channel to the second segment of the channel so as to couple the first segment of the channel in gaseous communication with the second segment of the channel at the combustion zone. A lighter is coupled to the elongated body and is operable for applying lighting heat to the combustion zone for lighting a lighting end of a rolled tobacco product. The second segment of the channel defines an airflow pathway that extends from the second inlet to the combustion zone for channeling a current of combustion air through the second segment of the channel from the second inlet to the combustion zone in response to a presence of lighting heat in the combustion zone from the lighter to light a lighting end of a rolled tobacco product inserted into the first segment of the channel through the first inlet and received against the stop at the combustion zone. The stop is equidistant with respect to the first and second inlets of the elongated body, the first segment of the channel has a first length extending from the first inlet to the stop, the second segment of the channel has a second length extending from the second inlet to the stop, and the first length of the first segment of the channel is equal to the second length of the second segment of the channel. The first inlet is in-line with respect to the second inlet, and the first and second segments of the channel are coaxial. In this embodiment, the lighter is a flame lighter and the lighting heat is flame lighting heat. A nozzle structure is formed in the elongated body proximate to the combustion zone. The nozzle structure is coupled between the flame lighter and the combustion zone so as to receive flame lighting heat from the flame lighter and diffuse the flame lighting heat into the combustion zone from many directions.

According to the principle of the invention, a portable, handheld lighter assembly for lighting a lighting end of a rolled tobacco product, such as a cigarette or a cigar, includes an elongated body, a channel that extends through the elongated body from a first inlet of the elongated body to an opposed second inlet of the elongated body, and an electric lighter that is coupled to the elongated body. The electric lighter includes an igniter element positioned in a combustion zone of the channel between the first and second inlets so as to define a first segment of the channel for the reception of a lighting end of a rolled tobacco product therein through the first inlet and an opposed second segment of the channel, the first segment of the channel extends from the first inlet to the combustion zone and the igniter element, and the second segment of the channel extends from the second inlet to the combustion zone and the igniter element. The igniter element is for interacting with a lighting end of a rolled tobacco product inserted into the first segment of the channel through the first inlet for restricting movement of the rolled tobacco product into the second segment of the channel from the first segment of the channel. The combustion zone traverses the igniter element from the first segment of the channel to the second segment of the channel so as to couple the first segment of the channel in gaseous communication with the second segment of the channel at the combustion zone. The electric lighter is operable for applying lighting heat to the combustion zone from the igniter element for lighting a lighting end of a rolled tobacco product. The second segment of the channel defines an airflow pathway that extends from the second inlet to the combustion zone for channeling a current of combustion air through the second segment of the channel from the second inlet to the combustion zone in response to a presence of lighting heat in the combustion zone from the igniter element of the electric lighter to light a lighting end of a rolled tobacco product inserted into the first segment of the channel through the first inlet and received against the igniter element at the combustion zone. The igniter element is equidistant with respect to the first and second inlets of the elongated body, the first segment of the channel has a first length extending from the first inlet to the igniter element, the second segment of the channel has a second length extending from the second inlet to the igniter element, and the first length of the first segment of the channel is equal to the second length of the second segment of the channel. The first inlet is in-line with respect to the second inlet, and the first and second segments of the channel are coaxial.

According to the principle of the invention, a portable, handheld lighter assembly for lighting a lighting end of a rolled tobacco product, such as a cigarette or a cigar, includes an elongated body, a channel that extends through the elongated body from a first inlet of the elongated body to an opposed second inlet of the elongated body, and a stop, which is coupled to the elongated body and which is positioned in a combustion zone of the channel between the first and second inlets so as to define a first segment of the channel for the reception of a lighting end of a rolled tobacco product therein through the first inlet and an opposed second segment of the channel for the reception of a lighting end of a rolled tobacco product therein through the second inlet. The first segment of the channel extends from the first inlet to the combustion zone and the stop, and the second segment of the channel extends from the second inlet to the combustion zone and the stop. The stop is for interacting with a lighting end of a rolled tobacco product inserted into the first segment of the channel through the first inlet for restricting movement of the rolled tobacco product into the second segment of the channel from the first segment of the channel, and for interacting with a lighting end of a rolled tobacco product inserted into the second segment of the channel through the second inlet for restricting movement of the rolled tobacco product into the first segment of the channel from the second segment of the channel. The combustion zone traverses the stop from the first segment of the channel to the second segment of the channel so as to couple the first segment of the channel in gaseous communication with the second segment of the channel at the combustion zone. A lighter is coupled to the elongated body and is operable for applying lighting heat to the combustion zone for lighting a lighting end of a rolled tobacco product. The first segment of the channel defines a first airflow pathway that extends from the first inlet to the combustion zone for channeling a current of combustion air through the first segment of the channel from the first inlet to the combustion zone in response to a presence of lighting heat in the combustion zone from the lighter to light a lighting end of a rolled tobacco product inserted into the second segment of the channel through the second inlet and received against the stop at the combustion zone. The second segment of the channel defines a second airflow pathway that extends from the second inlet to the combustion zone for channeling a current of combustion air through the second segment of the channel from the second inlet to the combustion zone in response to a presence of lighting heat in the combustion zone from the lighter to light a lighting end of a rolled tobacco product inserted into the first segment of the channel through the first inlet and received against the stop at the combustion zone. The stop is equidistant with respect to the first and second inlets of the elongated body, the first segment of the channel has a first length extending from the first inlet to the stop, the second segment of the channel has a second length extending from the second inlet to the stop, and the first length of the first segment of the channel is equal to the second length of the second segment of the channel. The first inlet is in-line with respect to the second inlet, and the first and second segments of the channel are coaxial and identical with respect to each other. The lighter is a flame lighter in this embodiment, and the lighting heat is flame lighting heat. A nozzle structure is formed in the elongated body proximate to the combustion zone. The nozzle structure is coupled between the flame lighter and the combustion zone so as to receive flame lighting heat from the flame lighter and diffuse the flame lighting heat into the combustion zone from many directions.

According to the principle of the invention, a portable, handheld lighter assembly for lighting a lighting end of a rolled tobacco product, such as a cigarette or a cigar, includes an elongated body, a channel that extends through the elongated body from a first inlet of the elongated body to an opposed second inlet of the elongated body, and an electric lighter that is coupled to the elongated body. The electric lighter includes an igniter element positioned in a combustion zone of the channel between the first and second inlets so as to define a first segment of the channel for the reception of a lighting end of rolled tobacco product therein through the first inlet and an opposed second segment of the channel for the reception of a lighting end of a rolled tobacco product therein through the second inlet. The first segment of the channel extends from the first inlet to the combustion zone and the igniter element, and the second segment of the channel extends from the second inlet to the combustion zone and the igniter element. The igniter element is for interacting with a lighting end of a rolled tobacco product inserted into the first segment of the channel through the first inlet for restricting movement of the rolled tobacco product into the second segment of the channel from the first segment of the channel, and for interacting with a lighting end of a rolled tobacco product inserted into the second segment of the channel through the second inlet for restricting movement of the rolled tobacco product into the first segment of the channel from the second segment of the channel. The combustion zone traverses the igniter element from the first segment of the channel to the second segment of the channel so as to couple the first segment of the channel in gaseous communication with the second segment of the channel at the combustion zone. The electric lighter is operable for applying lighting heat to the combustion zone from the igniter element for lighting a lighting end of a rolled tobacco product. The first segment of the channel defines a first airflow pathway that extends from the first inlet to the combustion zone for directing a current of combustion air through the first segment of the channel from the first inlet to the combustion zone in response to a presence of lighting heat in the combustion zone from the igniter element of the electric lighter to light a lighting end of a rolled tobacco product inserted into the second segment of the channel through the second inlet and received against the igniter element at the combustion zone. The second segment of the channel defines a second airflow pathway that extends from the second inlet to the combustion zone for directing a current of combustion air through the second segment of the channel from the second inlet to the combustion zone in response to a presence of lighting heat in the combustion zone from the igniter element of the electric lighter to light a lighting end of a rolled tobacco product inserted into the first segment of the channel through the first inlet and received against the igniter element at the combustion zone. The igniter element is equidistant with respect to the first and second inlets of the elongated body, the first segment of the channel has a first length extending from the first inlet to the igniter element, the second segment of the channel has a second length extending from the second inlet to the igniter element, and the first length of the first segment of the channel is equal to the second length of the second segment of the channel. The first inlet is in-line with respect to the second inlet, and the first and second segments of the channel are coaxial and identical with respect to each other.

According to the principle of the invention, a portable, handheld lighter assembly for lighting a lighting end of a rolled tobacco product, such as a cigarette or a cigar, includes an elongated body, a channel that extends through the elongated body from a first inlet of the elongated body to an opposed second inlet of the elongated body, and opposed first and second stops, which are coupled to the elongated body and which are positioned in a combustion zone of the channel between the first and second inlets so as to define a first segment of the channel for the reception of a lighting end of a rolled tobacco product therein through the first inlet and an opposed second segment of the channel for the reception of a lighting end of a rolled tobacco product therein through the second inlet, and a heat-receiving space of the combustion zone between the first and second stops. The first segment of the channel extends from the first inlet to the combustion zone and the first stop, and the second segment of the channel extends from the second inlet to the combustion zone and the second stop. A lighter is coupled to the elongated body and is operable for applying lighting heat to the heat-receiving space of the combustion zone for lighting a lighting end of a rolled tobacco product. The first stop is for interacting with a lighting end of a rolled tobacco product inserted into the first segment of the channel through the first inlet for restricting movement of the rolled tobacco product into the heat-receiving space of the combustion zone from the first segment of the channel, the second stop is for interacting with a lighting end of a rolled tobacco product inserted into the second segment of the channel through the second inlet for restricting movement of the rolled tobacco product into the heat-receiving space of the combustion zone from the second segment of the channel. The combustion zone traverses the first and second stops from the first segment of the channel to the heat-receiving space and to the second segment of the channel so as to couple the first segment of the channel in gaseous communication with the second segment of the channel at the combustion zone. The first segment of the channel defines a first airflow pathway that extends from the first inlet to the combustion zone for channeling a current of combustion air through the first segment of the channel from the first inlet to the combustion zone in response to a presence of lighting heat in the heat-receiving space of the combustion zone from the lighter to light a lighting end of a rolled tobacco product inserted into the second segment of the channel through the second inlet and received against the second stop at the combustion zone. The second segment of the channel defines a second airflow pathway that extends from the second inlet to the combustion zone for channeling a current of combustion air through the second segment of the channel from the second inlet to the combustion zone in response to a presence of lighting heat in the heat-receiving space of the combustion zone from the lighter to light a lighting end of a rolled tobacco product inserted into the first segment of the channel through the first inlet and received against the first stop at the combustion zone. The first segment of the channel has a first length extending from the first inlet to the first stop, the second segment of the channel has a second length extending from the second inlet to the second stop, and the first length of the first segment of the channel is equal to the second length of the second segment of the channel. The first inlet is in-line with respect to the second inlet, and the first and second segments of the channel are coaxial and identical with respect to each other. In this embodiment, the lighter is a flame lighter and the lighting heat is flame lighting heat.

According to the principle of the invention, a portable, handheld lighter assembly for lighting a lighting end of a rolled tobacco product, such as a cigarette or a cigar, includes an elongated body that has opposed first and second extremities and a middle between the opposed first and second extremities, and a channel that extends through the elongated body from a first inlet formed in the first extremity of the elongated body to an opposed second inlet formed in the second extremity of the elongated body. A stop is coupled to the elongated body and is positioned in a combustion zone of the channel between the first and second inlets so as to define a first segment of the channel for the reception of a lighting end of a rolled tobacco product therein through the first inlet and an opposed second segment of the channel. The first segment of the channel extends from the first inlet to the combustion zone and the stop, and the second segment of the channel extends from the second inlet to the combustion zone and the stop. The stop is for interacting with a lighting end of a rolled tobacco product inserted into the first segment of the channel through the first inlet for restricting movement the rolled tobacco product into the second segment of the channel from the first segment of the channel. The combustion zone traverses the stop from the first segment of the channel to the second segment of the channel so as to couple the first segment of the channel in gaseous communication with the second segment of the channel at the combustion zone. A match opening extends through the middle of the elongated body between the first and second inlets to the combustion zone and is for the introduction of a lighted match into the combustion zone from the middle of the elongated body for applying lighting heat from the flame of the lighted match to the combustion zone for lighting a lighting end of a rolled tobacco product. The second segment of the channel defines a second airflow pathway that extends from the second inlet to the combustion zone for channeling a current of combustion air through the second segment of the channel from the second inlet to the combustion zone in response to a presence of lighting heat in the combustion zone from the flame of a lighted match introduced into the combustion zone through the match opening to light a lighting end of a rolled tobacco product inserted into the first segment of the channel through the first inlet and received against the stop at the combustion zone. The stop is equidistant with respect to the first and second inlets of the elongated body. The first segment of the channel has a first length extending from the first inlet to the stop, the second segment of the channel has a second length extending from the second inlet to the stop, and the first length of the first segment of the channel is equal to the second length of the second segment of the channel. The first inlet is in-line with respect to the second inlet, and the first and second segments of the channel are coaxial. The match opening is equidistant with respect to the first and second inlets of the elongated body.

According to the principle of the invention, a portable, handheld lighter assembly for lighting a lighting end of a rolled tobacco product, such as a cigarette or a cigar, includes an elongated body that has opposed first and second extremities and a middle between the opposed first and second extremities, and a channel that extends through the elongated body from a first inlet formed in the first extremity of the elongated body to an opposed second inlet formed in the second extremity of the elongated body. A stop is coupled to the elongated body and is positioned in a combustion zone of the channel between the first and second inlets so as to define a first segment of the channel for the reception of a lighting end of rolled tobacco product therein through the first inlet and an opposed second segment of the channel for the reception of a lighting end of a rolled tobacco product therein through the second inlet. The first segment of the channel extends from the first inlet to the combustion zone and the stop, and the second segment of the channel extends from the second inlet to the combustion zone and the stop. The stop is for interacting with a lighting end of a rolled tobacco product inserted into the first segment of the channel through the first inlet for restricting movement the rolled tobacco product into the second segment of the channel from the first segment of the channel, and is for interacting with a lighting end of a rolled tobacco product inserted into the second segment of the channel through the second inlet for restricting movement the rolled tobacco product into the first segment of the channel from the second segment of the channel. The combustion zone traverses the stop from the first segment of the channel to the second segment of the channel so as to couple the first segment of the channel in gaseous communication with the second segment of the channel at the combustion zone. A match opening extends through the middle of the elongated body between the first and second inlets to the combustion zone and is for the introduction of a lighted match into the combustion zone from the middle of the elongated body for applying lighting heat from the flame of the lighted match to the combustion zone for lighting a lighting end of a rolled tobacco product. The first segment of the channel defines a first airflow pathway that extends from the first inlet to the combustion zone for channeling a current of combustion air through the first segment of the channel from the first inlet to the combustion zone in response to a presence of lighting heat in the combustion zone from the flame of a lighted match introduced into the combustion zone through the match opening to light a lighting end of a rolled tobacco product inserted into the second segment of the channel through the second inlet and received against the stop at the combustion zone. The second segment of the channel defines a second airflow pathway that extends from the second inlet to the combustion zone for channeling a current of combustion air through the second segment of the channel from the second inlet to the combustion zone in response to a presence of lighting heat in the combustion zone from the flame of a lighted match introduced into the combustion zone through the match opening to light a lighting end of a rolled tobacco product inserted into the first segment of the channel through the first inlet and received against the stop at the combustion zone. The stop is equidistant with respect to the first and second inlets of the elongated body. The first segment of the channel has a first length extending from the first inlet to the stop, the second segment of the channel has a second length extending from the second inlet to the stop, and the first length of the first segment of the channel is equal to the second length of the second segment of the channel. The first inlet is in-line with respect to the second inlet, and the first and second segments of the channel are coaxial and identical with respect to each other. The match opening is equidistant with respect to the first and second inlets of the elongated body.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION

Figure 1:
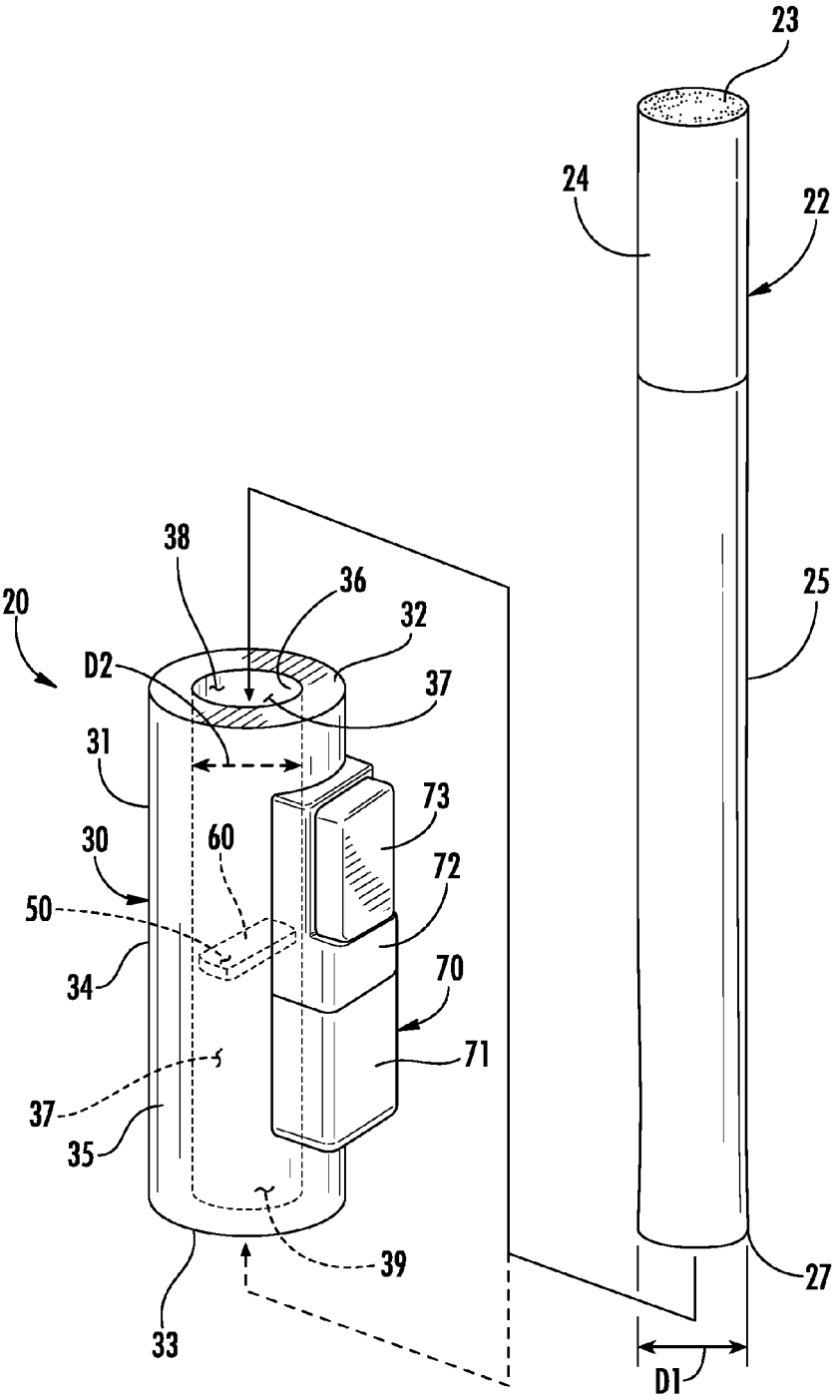
FIG. 1 is a perspective view of a lighter assembly constructed and arranged in accordance with the principle of the invention, and also a rolled tobacco product in the form of a cigarette depicted near the lighter assembly in preparation for lighting.

Turning now to the drawings, in which like reference characters indicate corresponding elements throughout the several views, attention is first directed to FIG. 1 in which there is illustrated a lighter assembly 20 constructed and arranged in accordance with the principle of the invention. Lighter assembly 20 is useful for lighting the lighting end of a rolled tobacco product to be smoked, such as a cigarette or a cigar. In the present embodiment, lighter assembly 20 is uniquely adapted to light a rolled tobacco product in the form of a cigarette 22 for smoking and is therefore an exemplary cigarette lighter assembly, and in FIG. 1 a highly generalized representation of a conventional cigarette 22 is depicted near lighter assembly 20 in preparation for lighting. The term "cigarette" means "small cigar" and originated in France in the 1830's. A cigarette is a form of a rolled tobacco product consisting of a cylindrical roll of tobacco cured for smoking. A cigarette is a form of a cigar, but it is considerably smaller than most or typical cigars and is usually wrapped in thin rolling paper. Cigarette 22 depicted in FIG. 1 is exemplary of a conventional cigarette and in structure consists of a filter or filtering end consisting of a filter 23 covered by tipping paper 24, and a cylindrical roll of tobacco 25 that consists of the usual rolling paper covering and holding the tobacco and which has an outer diameter D1. Cigarette 22 is lighted at the lighting end 27 of roll of tobacco 25, and is allowed to smolder and its smoke is inhaled from the opposed filter or filtering end of cigarette 22, which is held in or to the mouth. Cigarette 22 in FIG. 1 is exemplary of a common and readily available cigarette, which is approximately 70 mm long, with an outer diameter D1 of approximately 10 mm, and these are standard dimensions for common and readily-available standard-sized cigarettes. Lighter assembly 20 is discussed below in connection with cigarette 22, with the general understanding the lighter assembly 20 is useful for lighting rolled tobacco products, such as cigarettes or cigars. Furthermore, because cigarette 22 is a form of a rolled tobacco product, the terms "cigarette" and "rolled tobacco product" in relation to reference numeral 22 may be used interchangeably.

Figure 2:
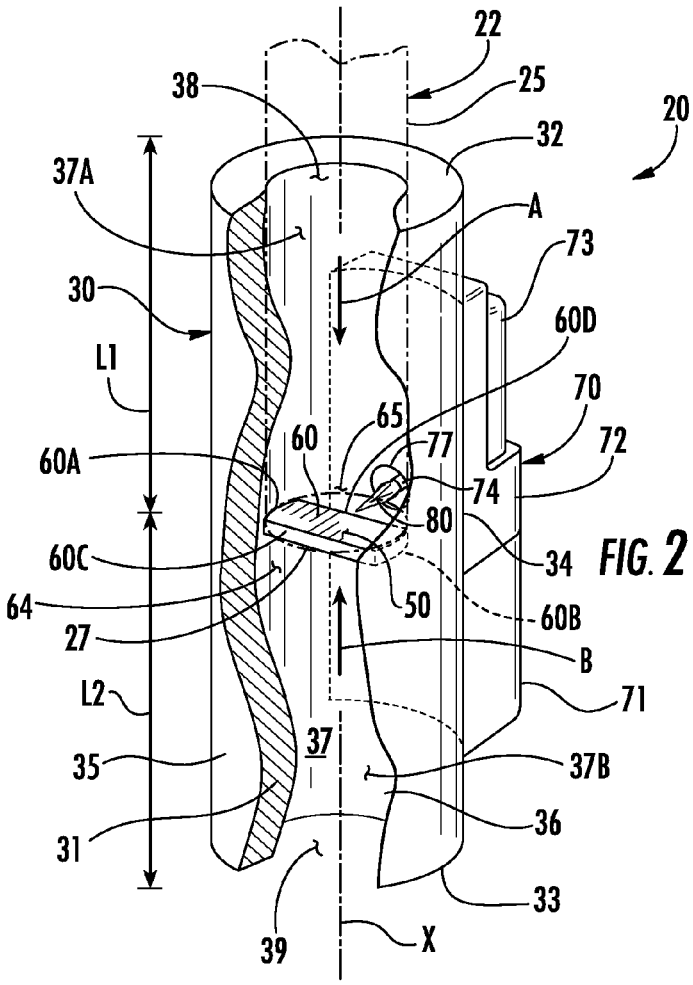
FIG. 2 is a perspective view of the lighter assembly of FIG. 1 with portions thereof broken away for illustrative purposes, and further illustrating a length of the cigarette in phantom outline shown as it would appear inserted into the lighter assembly for lighting a lighting end of the cigarette.

Referring in relevant part to FIGS. 1 and 2, lighter assembly 20 is a handheld lighter which means that in size it is small enough to be used or operated while being held in the hand or hands, and is also portable which means that it is easily carried or conveyed about by hand or hands. Lighter assembly 20 includes an elongated fixture or body denoted generally at 30, which is formed of a material or combination of materials having the properties of wear-resistances, oxidation resistances, shock resistances, rigidity, and resistance to heat, such as preferably a ceramic or a combination of ceramic materials, and is preferably integrally formed and may, if desired, be formed of a plurality of attached or assembled parts. In an alternate embodiment elongated body 30 may be formed of insulated metal casing material.

In the present embodiment, elongated body 30 is a tube or is tubular and consists of a cylindrical, upstanding, continuous sidewall 31 having opposed ends or extremities 32 and 33, a middle or mid-section 34 between extremities 32 and 33, and opposed outer and inner surfaces 35 and 36 that extend between extremities 32 and 33. Inner surface 36 bounds and defines a channel 37 that extends through elongated body 30. Channel 37 is cylindrical and has an inner diameter D2 denoted in FIG. 3, and extends through elongated body 30 from an inlet 38 to channel 37 formed in extremity 32 of elongated body 30 to an opposed inlet 39 to channel 37 formed in extremity 33 of elongated body 30. A central axis X extends centrally through channel 37 from inlet 38 to inlet 39 about which channel 37 and elongated body 30 are symmetrical.

Inlet 38 formed in extremity 32 of elongated body 30 is an opening for the intake into channel 37 of a rolled tobacco product to be lighted and combustion air to stimulate lighting in the direction indicated by arrowed line A in FIG. 2 toward middle 34, and inlet 39 formed in extremity 33 of elongated body 30 is an opening for the intake into channel 37 of a rolled tobacco product to be lighted and combustion air to stimulate lighting in the direction indicated by arrowed line B in FIG. 2 toward middle 34. Elongated body 30 has a length extending from extremity 32 to extremity 33. Channel 37 extends completely through elongated body 30 along the entire length of elongated body 30 from inlet 38 of extremity 32 to inlet 39 of extremity 33. The inner diameter D2 of channel 37 is uniform along the entire length of channel 37 from inlet 38 of extremity 32 to inlet 39 of extremity 33, and extremity 32 and inlet 38 are together parallel with respect to extremity 33 and inlet 39. The inner diameter D2 of channel 37 relates to, and is somewhat greater than, diameter D1 of rolled tobacco product 22 illustrated in FIG. 1 so as to permit the reception of lighting end 27 of rolled tobacco product 22 therein through inlet 38 and also through inlet 39. In this present embodiment, the outer diameter D1 of rolled tobacco product 22 is approximately 10 mm, and the corresponding inner diameter D2 of channel 37 is approximately 10.5 mm so as to permit the reception of a rolled tobacco product without tearing or damaging the rolled tobacco product.

Middle 34 of elongated body 30 is equidistant with respect to extremities 32 and 33. Looking to FIG. 2, the area of channel 37 at middle 34 of elongated body 30 is a combustion area or zone 50 of lighter assembly 20 where the lighting of the lighting end of a rolled tobacco product takes place through the application of lighting heat applied to combustion zone 50 in accordance with the principle of the invention. A stop 60, which is an elongate bar and which has opposed ends 60A and 60B and opposed sides 60C and 60D that extend between ends 60A and 60B, is coupled to elongated body 30 and is positioned at middle 34 of elongated body 30 and is located in channel 37 at or otherwise in combustion zone 50 of channel in accordance with the principle of the invention. Ends 60A and 60B of stop 60 are rigidly affixed to inner surface 36 of elongated body 30 on either side of channel 37, such as by adhesive, heat bonding, or the like, and stop 60 extends transversely across channel 37 and is centrally located in combustion zone 50 of channel 37 and is parallel with respect to extremity 32 and inlet 38, and also to extremity 33 and inlet 39.

With stop 60 coupled to elongated body 30 and located in combustion zone 50 at middle 34 of elongated body 30 between inlets 38 and 39 of the respective extremities 32 and 33 of elongated body 30 as depicted in FIG. 2, two opposed segments 37A and 37B of channel 37 are delineated or otherwise defined in elongated body 30 of lighter assembly 20. Segment 37A of channel 37 is itself a channel or a channel portion in relation to channel 37 and extends from inlet 38 at extremity 32 of elongated body 30 to combustion zone 50 and stop 60 and the entire length of segment 37A of channel 37 from inlet 38 at extremity 32 to stop 60 has inner diameter D2 that relates to, and that is somewhat greater than, diameter D1 of rolled tobacco product 22 illustrated in FIG. 1 so as to permit the reception of lighting end 27 of rolled tobacco product 22 into segment 37A through inlet 38 without tearing or damaging the rolled tobacco product. Segment 37B of channel 37 is itself a channel or a channel portion in relation to channel 37 and extends from inlet 39 at extremity 33 of elongated body 30 to combustion zone 50 and stop 60 and the entire length of segment 37B of channel 37 from inlet 39 at extremity 33 to stop 60 has inner diameter D2 that relates to, and that is somewhat greater than, diameter D1 of rolled tobacco product 22 illustrated in FIG. 1 so as to permit the reception of lighting end 27 of rolled tobacco product 22 into segment 37B through inlet 39 without tearing or damaging the rolled tobacco product. Segment 37A of channel 37 is for the intake/reception therein through inlet 38 in the direction of arrowed line A in FIG. 2 of lighting end 27 of rolled tobacco product 22 to be lighted at combustion zone 50 through the application of lighting heat at combustion zone 50 and is therefore considered to be one rolled tobacco product-receiving segment of channel 37. Segment 37B of channel 37 is, likewise, for the intake/reception therein through inlet 39 in the direction of arrowed line B in FIG. 2 of lighting end 27 of rolled tobacco product 22 to be lighted at combustion zone 50 through the application of lighting heat at combustion zone 50 and is therefore considered to be another rolled tobacco product-receiving segment of channel 37. Furthermore, segment 37A of channel 37 is for the intake/reception therein through inlet 38 in the direction of arrowed line A in FIG. 2 of combustion air to stimulate the lighting of a lighting end of a rolled tobacco product applied into segment 37B of channel 37, and segment 37B of channel 37 is, likewise, for the intake/reception therein through inlet 39 in the direction of arrowed line B in FIG. 2 of combustion air to stimulate the lighting of a lighting end of a rolled tobacco product applied into segment 37A of channel 37.

Stop 60 is equidistant with respect to inlets 38 and 39 of elongated body 30, and also extremities 32 and 33 of elongated body 30. Segment 37A of channel 37 has a length L1 that extends from inlet 38 to stop 60, and segment 37B of channel 37 has a second length L2 that extends from inlet 39 to stop 60. Length L1 segment 37A of channel 37 is equal to length L2 of segment 37B of channel 37 in this preferred embodiment. In this example, lengths L1 and L2 of segments 37A and 37B of channel 37 are each approximately 25 mm in length.

Inlet 38 formed in extremity 32 of elongated body 30 is in-line and identical in size and shape with respect to opposing inlet 39 formed in extremity 33 of elongated body 30, and inlets 38 and 39 are coaxial in that they encircle and share axis X, which extends through the geometric center of inlets 38 and 39 about which inlets 38 and 39 are symmetrical. In other words, it will be understood that inlets 38 and 39 are the mirror image opposites of one another Likewise, segment 37A of channel 37 is in-line and identical in size and shape with respect to opposing segment 37B of channel 37, and segments 37A and 37B of channel 37 are coaxial in that they encircle and share axis X, which extends through the geometric center of segments 37A and 37B of channel 37 about which segments 37A and 37B of channel 37 are symmetrical. In other words, it will be understood that segments 37A and 37B of channel 37 are the minor image opposites of one another.

Figure 3:
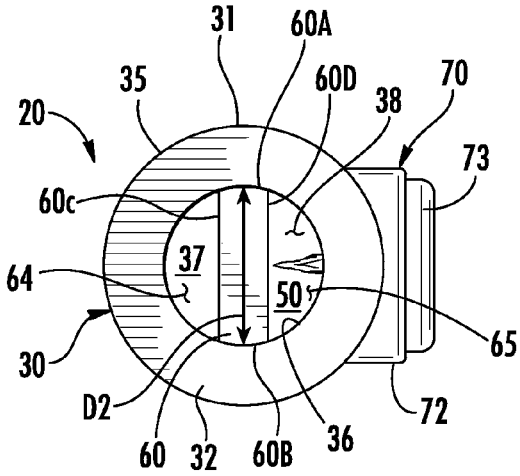
FIG. 3 is a top plan view of the lighter assembly of FIG. 1.

Looking to FIGS. 2 and 3, there are opposed gaps 64 and 65 defined at combustion zone 50 between inner surface 36 of elongated body 30 and the corresponding sides 60C and 60D of stop 60. These gaps 64 and 65 are part of combustion zone 50 and traverse stop 60 from segment 37A of channel 37 to segment 37B of channel 37 so as to couple segment 37A of channel 37 in gaseous communication with segment 37B of channel 37 at combustion zone 50.

As explained above, segment 37A of channel 37 is for the reception of lighting end 27 of rolled tobacco product 22 therein through inlet 38 and is considered to be a rolled tobacco product-receiving segment of channel 37. To illustrate this, in FIG. 2 a length of roll of tobacco 25 of rolled tobacco product 22 as depicted in phantom outline is shown as it would appear inserted lighting end 27 first into segment 37A of channel 37 through inlet 38 for lighting the lighting end 27 of rolled tobacco product 22 through the application of lighting heat applied to combustion zone 50. When the length of rolled tobacco product 22 is inserted lighting end 27 first into segment 37A of channel 37 through inlet 38, it is moved through segment 37A of channel 37 toward stop 60 in the direction of arrowed line A until lighting end 27 of rolled tobacco product 22 directly abuttingly contacts or otherwise directly contacts or abuts against stop 60, which stops further movement of rolled tobacco product 22 and sets or otherwise locates lighting end 27 of rolled tobacco product 22 in combustion zone 50 of lighter assembly 20 in preparation for lighting through the application of lighting heat applied to combustion zone 50. And so stop 60 in combustion zone 50 of channel 37 is for interacting with lighting end 27 of rolled tobacco product 22 inserted lighting end 27 first into segment 37A of channel 37 through inlet 38 via a direct abutting contact of lighting end 27 of rolled tobacco product 22 against stop 60 for restricting movement of rolled tobacco product 22 past stop 60 and into segment 37B of channel 37 from segment 37A of channel 37 so as to position or set lighting end 27 of rolled tobacco product 22 at combustion zone 50 along the side of stop 60 facing into segment 37A of channel 37 of lighter assembly 20 in preparation for lighting the lighting end 27 of rolled tobacco product 22 through the application of lighting heat applied to combustion zone 50. In lighter assembly 20, the application of lighting heat to combustion zone 50 for lighting the lighting end of a rolled tobacco product is provided by lighter 70 of lighter assembly 20.

Referring to FIGS. 1-3 in relevant part, lighter 70 is coupled to elongated body 30 and is operatively coupled to combustion zone 50 of lighter assembly 20 so as to be operative for applying lighting heat to combustion zone 50 sufficient to cause a lighting of lighting end 27 of rolled tobacco product 22 applied to combustion zone 50 as explained above. In lighter assembly 20, lighter 70 is a flame lighter that provides flame lighting heat from a generated flame to light a rolled tobacco product, and includes a fuel canister part 71, an actuator part 72 with a switch plunger or button 73, and, as seen in FIG. 2, a flame nozzle 74. Lighter 70 is rigidly affixed to outer surface 35 of elongated body 30, such as with rivets or other fasteners, adhesive, welding, or the like, and is centrally located between extremities 32 and 33 of elongated body 30.

Continuous sidewall 31 of elongated body 30 is formed with an opening 77. Opening 77 extends through continuous sidewall 31 from outer surface 35 to inner surface 36 at middle 34 of elongated body 30 and faces or otherwise opposes combustion zone 50 and stop 60 as shown in FIG. 2. Flame nozzle 74 is applied to opening 77 so as to oppose combustion zone 50 and stop 60, and flame nozzle 74 and opening 77, which may be considered a nozzle opening in conjunction with lighter assembly 20, are equidistant with respect to inlets 38 and 39, and with respect to extremities 32 and 33. Nozzle 74 is conventionally operatively coupled to receive lighting fuel, such as butane, held by fuel canister part 71, and switch plunger or button 73 is spring-loaded and that moves conventionally between an undepressed OFF position as shown in FIG. 1 deactivating lighter 70 and a depressed ON position as shown in FIG. 2 activating lighter 70 so as to cause a controlled ignition and combustion of the lighting fuel from fuel canister part 71 to produce a flame 80 from flame nozzle 74 as shown in FIG. 2, which flame nozzle 74 directs into combustion zone 50 from opening 77 for lighting the lighting end 27 of rolled tobacco product 22 applied to combustion zone 50 at segment 37A of channel 37. Button 73 is held in its depressed ON position to maintain flame 80, and by releasing the force required to depress button 73 it happens that button 73 displaces from its depressed ON position to produce and maintain flame 80 to its un-depressed OFF position deactivating lighter 70 and shutting down or otherwise extinguishing the flame. Lighter 70 is generally representative of a conventional butane lighter, further details of which will readily occur to the skilled artisan and will not be discussed in detail.

Segment 37B of channel 37 defines an airflow pathway from inlet 39 to combustion zone 50 for channeling a current of combustion air through segment 37B of channel 37 from inlet 39 to combustion zone 50 in the direction of arrowed line B in response to a presence of the lighting heat in combustion zone 50 from flame 80 formed by lighter 70 to promote the lighting of lighting end 27 of rolled tobacco product 22 inserted into segment 37A of channel 37 through inlet 38 and received against stop 60 at combustion zone 50. The gases formed by the combustion of the lighting fuel from fuel canister part 71 in combustion zone 50 via flame 80, i.e., flue gases, are much hotter than the ambient outside air and therefore less dense than the ambient air. This causes combustion zone 50 to have a lower pressure than the pressure of the ambient air at inlet 39 to segment 37B of channel 37. This higher pressure of the ambient air at inlet 39 to segment 37B of channel 37 is a driving force that moves combustion air into and through segment 37B of channel 37 from inlet 39 to combustion zone 50 in the direction of arrowed line B to promote combustion of lighting end 27 of rolled tobacco product 22 applied to combustion zone 50 at segment 37A of channel 37, and also moves the resulting combustion flue gas up and out of segment 37A of channel 37 through rolled tobacco product 22 applied to segment 37A of channel 37 and inlet 38 in the direction of arrowed line B. With rolled tobacco product 22 applied to segment 37A of channel 37 during this lighting of lighting end 27, as it happens as soon as lighting end 27 of rolled tobacco product 22 is lighted sufficiently the smoke from the burning lighting end 27 is forced through rolled tobacco product 22 and escapes from the filtered end of rolled tobacco product 22 so as to indicate when rolled tobacco product 22 is lighted, whereupon button 73 is released so as to deactivate lighter 70 and rolled tobacco product 22 is pulled outwardly from segment 37A of channel 37 through inlet 38 in the direction of arrowed line B for smoking in the normal manner. This movement or flow of combustion air and flue gases through channel 37 in the direction of arrowed line B in the lighting of rolled tobacco product 22 applied to combustion zone 50 via segment 37A of channel 37 is called natural draught/draft, natural ventilation, chimney effect, or stack effect. The lengths L1 and L2 of segments 37A and 37B of channel 37 and also the overall length of channel 37 between inlets 38 and 39 are chosen to produce this beneficial draught or draft. During the lighting of rolled tobacco product 22 applied to combustion zone 50 via segment 37A of channel 37, flame 80 in combustion zone 50 and lighting end 27 of rolled tobacco product 22 in combustion zone 50 are protectively enclosed in combustion zone 50 bound by elongated body 30 and are thereby protected or otherwise isolated from external influences, such as wind and rain, that could impede either the formation of the lighting flame or the combustion of lighting end 27 of rolled tobacco product 22.

The discussion above explains in detail how segments 37A and 37B of channel 37 operate in the lighting of a rolled tobacco product applied to combustion zone 50 via segment 37A of channel 37 of lighter assembly 20. Segments 37A and 37B of channel 37 are identical and relate to stop 60, combustion zone 50, and lighter 70 identically and operate in the same way in the lighting of a rolled tobacco product applied to combustion zone 50 via either segment 37A of channel 37 or segment 37B of channel 37 of lighter assembly 20. In this way, a user need not have to concern himself as to which of the segments 37A and 37B of channel 37 to use in the lighting of a rolled tobacco product because they both are and function identically with respect to each other, in accordance with the principle of the invention.

To explain briefly the operation of segment 37B of lighter assembly 20, segment 37B of channel 37 is for the reception of a lighting end of a rolled tobacco product therein through inlet 39 and is considered to be, like segment 37A, another rolled tobacco product-receiving segment of channel 37. To light a rolled tobacco product through the use of segment 37B of channel 37, a length of roll of tobacco of a rolled tobacco product is inserted lighting end first into segment 37B of channel 37 through inlet 39 for lighting the lighting end of the rolled tobacco product through the application of lighting heat applied to combustion zone 50. When the length of the rolled tobacco product is inserted lighting end first into segment 37B of channel 37 through inlet 39, it is moved through segment 37B of channel 37 toward stop 60 in the direction of arrowed line B until the lighting end of the rolled tobacco product directly abuttingly contacts or otherwise directly contacts or abuts against stop 60, which stops further movement of the rolled tobacco product and sets or otherwise locates the lighting end of the rolled tobacco product in combustion zone 50 of lighter assembly 20 in preparation for lighting through the application of lighting heat applied to combustion zone 50. And so stop 60 in combustion zone 50 of channel 37 is for interacting with the lighting end of a rolled tobacco product inserted lighting end first into segment 37B of channel 37 through inlet 39 via a direct abutting contact of the lighting end of the rolled tobacco product against stop 60 for restricting movement of the rolled tobacco product past stop 60 and into segment 37A of channel 37 from segment 37B of channel 37 so as to position or set the lighting end of the rolled tobacco product at combustion zone 50 along the side of stop 60 facing into segment 37B of channel 37 of lighter assembly 20 in preparation for lighting the lighting end of the rolled tobacco product through the application of lighting heat applied to combustion zone 50 from lighter 70 as explained above.

Segment 37A of channel 37 defines an airflow pathway from inlet 38 to combustion zone 50 for channeling a current of combustion air through segment 37A of channel 37 from inlet 38 to combustion zone 50 in the direction of arrowed line A in response to a presence of the lighting heat in combustion zone 50 from flame 80 formed by the activation of lighter 70 to promote the lighting of the lighting end of the rolled tobacco product inserted into segment 37B of channel 37 through inlet 39 and received against stop 60 at combustion zone 50. The gases formed by the combustion of the lighting fuel from fuel canister part 71 in combustion zone 50 via flame 80, i.e., flue gases, are much hotter than the ambient outside air and therefore less dense than the ambient air. This causes combustion zone 50 to have a lower pressure than the pressure of the ambient air at inlet 38 to segment 37A of channel 37. This higher pressure of the ambient air at inlet 38 to segment 37A of channel 37 is the driving force that moves combustion air into and through segment 37A of channel 37 from inlet 38 to combustion zone 50 in the direction of arrowed line A in FIG. 2 to promote combustion of the lighting end of rolled tobacco product applied to combustion zone 50 at segment 37B of channel 37, and also moves the resulting combustion flue gas up and out of segment 37B of channel 37 through the rolled tobacco product applied to segment 37B of channel 37 and inlet 39 in the direction of arrowed line A. With the rolled tobacco product applied to segment 37B of channel 37 during this lighting of the lighting end of a rolled tobacco product applied to the combustion zone 50 via segment 37B of channel 37, as it happens as soon as the lighting end of the rolled tobacco product is lighted sufficiently the smoke from the burning lighting end of the rolled tobacco product is forced through the rolled tobacco product and escapes from the filtered end of the rolled tobacco product so as to indicate when the rolled tobacco product is lighted, whereupon lighter 70 is deactivated to extinguish the flame and the rolled tobacco product is pulled outwardly from segment 37B of channel 37 through inlet 39 in the direction of arrowed line A for smoking in the normal manner.

This movement or flow of combustion air and flue gases through channel 37 in the direction of arrowed line A in the lighting of a rolled tobacco product applied to combustion zone 50 via segment 37B of channel 37 is called natural draught/draft, natural ventilation, chimney effect, or stack effect. Again, the lengths L1 and L2 of segments 37A and 37B of channel 37 and also the overall length of channel 37 between inlets 38 and 39 are chosen to produce this beneficial draught or draft. During the lighting of a rolled tobacco product applied to combustion zone 50 via segment 37B of channel 37, the flame in combustion zone 50 provided by lighter 70 and lighting end 27 of rolled tobacco product 22 in combustion zone 50 are protectively enclosed in combustion zone 50 bound by elongated body 30 and are thereby protected or otherwise isolated from external influences, such as wind and rain, that could impede either the formation of the lighting flame or the combustion of lighting end 27 of rolled tobacco product 22. Although not shown in lighter assembly 20, lighter 70 can be formed with a lighter flame adjustment for adjusting the size or strength of the generated flame, and a fuel valve for refilling fuel canister part 71 with lighter fuel, which, in the present embodiment of lighter 70, would be butane lighter fuel.

Figure 4:
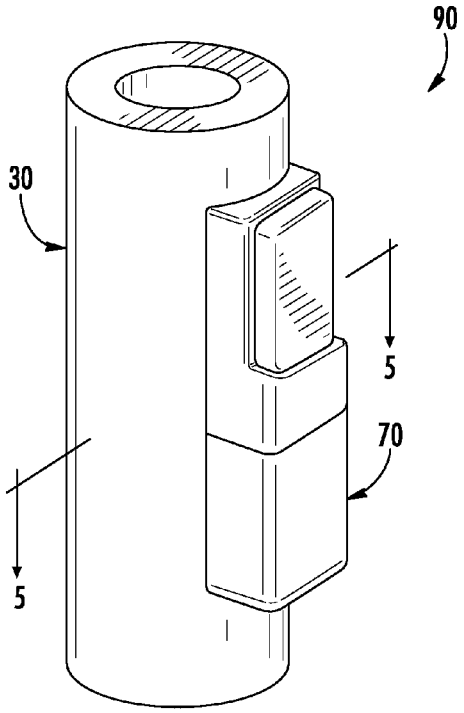
FIG. 4 is a perspective view of a lighter assembly constructed and arranged in accordance with an alternate embodiment of the invention.
Figure 5:
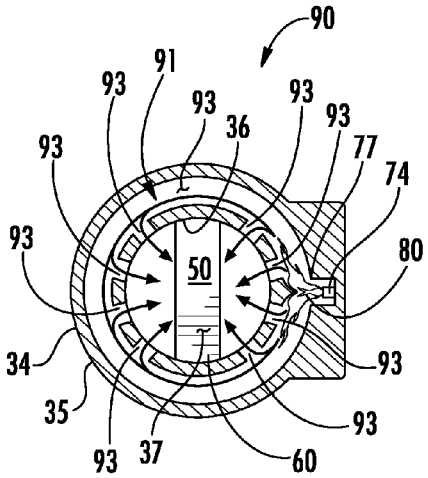
FIG. 5 is a section view taken along line 5-5 of FIG. 4.
Figure 6:
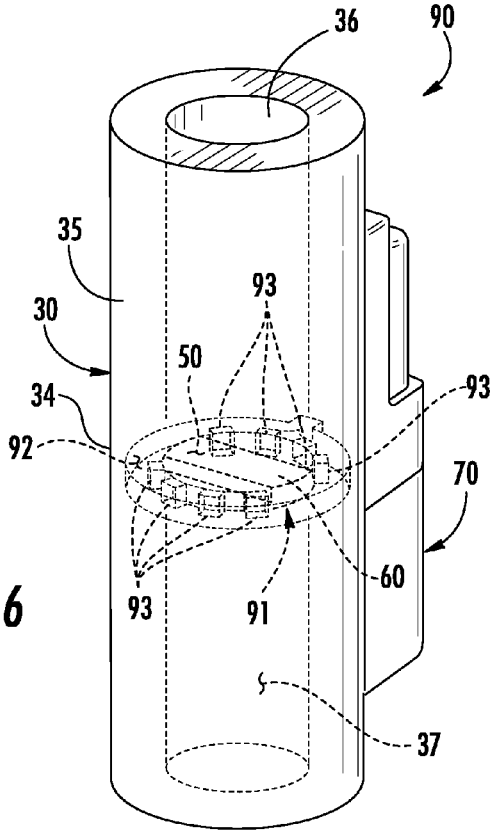
FIG. 6 is view similar to that of FIG. 1 with portions of the lighter assembly, including a channel and a nozzle structure, being depicted schematically in phantom outline for illustration and reference.

Reference is now made to FIG. 4, which is a perspective view of a lighter assembly 90 constructed and arranged in accordance with an alternate embodiment of the invention. In common with lighter assembly 20, lighter assembly 90 shares elongated body 30, including stop 60, and lighter 70 and is identical in every respect in its structure and operation as compared to lighter assembly 20 as discussed in detail above with the exception that, unlike lighter assembly 20, the only difference between lighter assembly 90 and lighter assembly 20 is that lighter assembly 90 is formed with a nozzle structure 91 depicted in FIGS. 5 and 6. Looking to FIGS. 5 and 6, nozzle structure 91 is formed in elongated body 30 proximate to combustion zone 50, and operatively coupled to lighter 70 and combustion zone 50 so as to receive flame lighting heat from lighter 70 and diffusingly direct the flame lighting heat into to combustion zone 50 from many directions. Nozzle assembly 91 consists of an annular channel 92 formed in continuous sidewall 31 at middle 34 of elongated body 30 between outer and inner surfaces 35 and 36 of continuous sidewall 31. Opening 77 to flame nozzle 74 leads to annular channel 92 as shown in FIG. 5, and numerous ports 93 are formed in continuous sidewall 31 of elongated body 30 between annular channel 92 and inner surface 36 of elongated body bounding combustion zone 50 of channel 37. Ports 93 are spaced apart and surround combustion zone 50 and in the present embodiment there are eight ports 93 in nozzle structure 91. Annular channel 92 receives flame 80 generated by the activation of lighter 70, and ports 93, in turn, conduct the lighting heat in the form of the flame lighting heat generated by flame 80 from annular channel 91 into combustion zone 50 from many directions surrounding combustion zone 50 in order to light the lighting end of a rolled tobacco product applied to combustion zone 50. There are eight ports 93 in the present embodiment surrounding combustion zone 50 that thereby conduct lighting heat into combustion zone 50 from eight different directions surrounding combustion zone 50. Although there are eight ports 93 in nozzle structure 91 of lighter assembly 90, there can be less or more ports formed in nozzle structure 91 as may be desired. Other than the provision of nozzle structure 91, lighter assembly 90 is identical in every respect to lighter assembly 20, and the discussion of lighter assembly 20 set forth above applies in every respect to lighter assembly 90.

Figure 7:
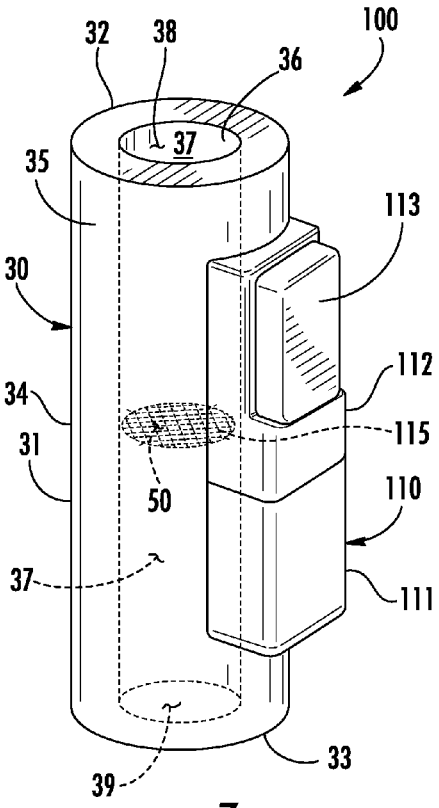
FIG. 7 is a perspective view of a lighter assembly constructed and arranged in accordance with yet another embodiment of the invention with portions of the lighter assembly, including a channel and an igniter element, being depicted schematically in phantom outline for illustration and reference.
Figure 8:
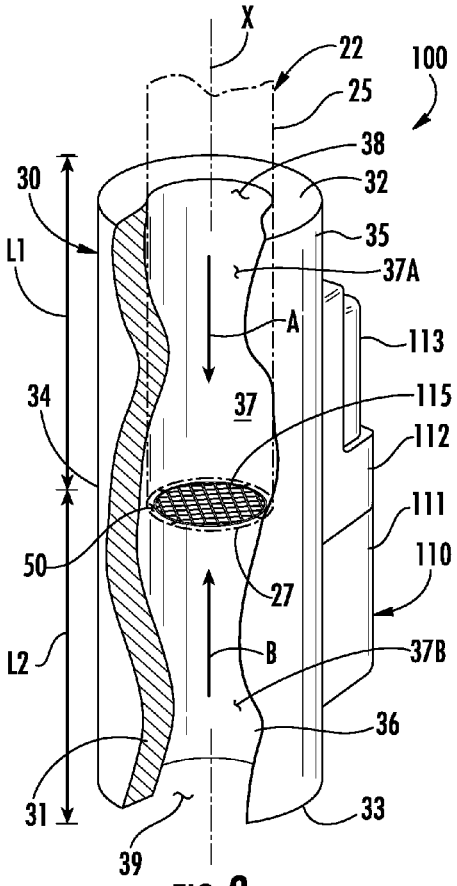
FIG. 8 is a perspective view of the lighter assembly of FIG. 7 with portions thereof broken away for illustrative purposes and further illustrating a length of a rolled tobacco product in the form of a cigarette in phantom outline shown inserted into the lighter assembly for lighting a lighting end of the cigarette.
Figure 9:
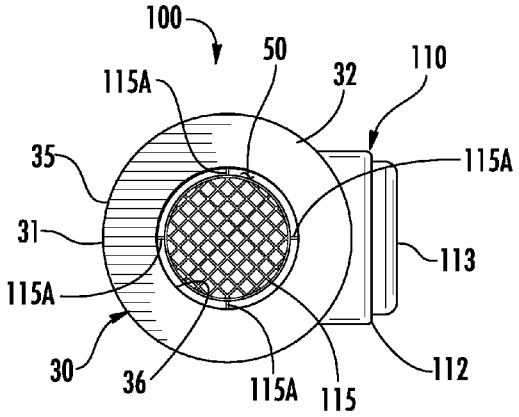
FIG. 9 is a top plan view of the lighter assembly of FIG. 7.

Turning now in relevant part to FIGS. 7-9 there is illustrated yet another alternate embodiment of the invention denoted generally at 100, which, in common to lighter assembly 20, shares elongated body 30 including continuous sidewall 31, extremities 32 and 33, middle 34, opposed outer and inner surfaces 35 and 36, channel 37 having inner diameter D2, inlets 38 and 39, central axis X that extends centrally through channel 37 from inlet 38 to inlet 39 about which channel 37 and elongated body 30 are symmetrical, combustion zone 50, segment 37A of channel having length L1, and segment 37B of channel having length L2, all as explained above in detail in connection with the embodiment of the lighter assembly denoted generally at 20. Lighter assembly 100 is formed stop 60 and a flame lighter denoted at 70. In lighter assembly 100, however, stop 60 of lighter assembly 20 is replaced with an igniter element 115, and lighter 70 of lighter assembly 20 is replaced with lighter 110. Lighter 110 is an electric lighter, and igniter element 115 forms a part of lighter 110. In lighter assembly 100, combustion zone 50 is where the lighting end of a rolled tobacco product takes place through the application of lighting heat applied to combustion zone 50 in accordance with the principle of the invention. Lighter 110 is coupled to elongated body 30 and is operatively coupled to combustion zone 50 of lighter assembly 100 so as to be operative for applying lighting heat to combustion zone 50 sufficient to cause a lighting of lighting end 27 of rolled tobacco product 22 applied to combustion zone 50. In lighter assembly 100, lighter 110 is an electric lighter that provides incandescent heat from igniter element 115 to light a rolled tobacco product, and includes an electric battery part 111, an actuator part 112 with a switch plunger or button 113, and, of course, igniter element 115.

Lighter 110 is rigidly affixed to outer surface 35 of elongated body 30, such as with rivets or other fasteners, adhesive, welding, or the like, and is centrally located between extremities 32 and 33 of elongated body 30. Igniter element 115 is a grate of resistance wire, preferably nichrome wire, through which an electric current passes when lighter 110 is activated so as to cause igniter element 115 to glowing orange hot in just a few seconds for lighting a rolled tobacco product. Igniter element 115 is coupled to elongated body 30 and is positioned at middle 34 of elongated body 30 and is located in channel 37 at or otherwise in combustion zone 50 of channel 37 in accordance with the principle of the invention. Appendages 115A (see FIG. 9) of igniter element 115 are rigidly affixed to inner surface 36 of elongated body 30 on either side of channel 37, such as by adhesive, heat bonding, or the like, and igniter element 115 extends transversely across channel 37 and is centrally located in combustion zone 50 of channel 37 and is parallel with respect to extremity 32 and inlet 38, and also to extremity 33 and inlet 39.

Igniter element 115 is conventionally electrically connected to battery part 111, and switch plunger or button 113 is spring-loaded and moves conventionally between an undepressed OFF position as shown in FIG. 7 deactivating lighter 110 and a depressed ON position as shown in FIG. 8 activating lighter 110 so as to cause a controlled heating of igniter element 115 to produce heat in combustion zone 50 from igniter element 115 for lighting the lighting end 27 of rolled tobacco product 22 applied to combustion zone 50 at segment 37A of channel 37. Button 113 is held in its depressed ON position to maintain an electric current to igniter element 115 from battery part 111, and by releasing the force required to depress button 113 it happens that button 113 displaces from its depressed ON position for causing igniter element 115 to become heated to its un-depressed OFF position deactivating lighter 110 and shutting down the application of electric current to igniter element 115 from battery part 111 causing igniter element 115 to cool down in a matter of just a few seconds. Lighter 110 is generally representative of a conventional electric lighter, further details of which will readily occur to the skilled artisan and will not be discussed in detail.

Igniter element 115 is equidistant with respect to inlets 38 and 39 of elongated body 30, and also extremities 32 and 33 of elongated body 30. Segment 37A of channel 37 has length L1 that extends from inlet 38 to igniter element 115, and segment 37B of channel 37 has length L2 that extends from inlet 39 to igniter element 115. Length L1 of segment 37A of channel 37 is equal to length L2 of segment 37B of channel 37 in this preferred embodiment. In this example, lengths L1 and L2 of segments 37A and 37B of channel 37 are each approximately 25 mm in length as in the embodiment denoted generally at 20. Being a grate of resistance wire, igniter element 115 defines inherent small openings that extend through it, which form a part of combustion zone 50 and traverse igniter element 115 from segment 37A of channel 37 to segment 37B of channel 37 so as to couple segment 37A of channel 37 in gaseous communication with the segment 37B of channel 37 at combustion zone 50.

As explained above, segment 37A of channel 37 is for the reception of lighting end 27 of rolled tobacco product 22 therein through inlet 38 and is considered to be a rolled tobacco product-receiving segment of channel 37. To illustrate this in conjunction with lighter assembly 100, in FIG. 8 a length of roll of tobacco 25 of rolled tobacco product 22 as depicted in phantom outline is shown as it would appear inserted lighting end 27 first into segment 37A of channel 37 through inlet 38 for lighting the lighting end 27 of rolled tobacco product 22 through the application of lighting heat applied to combustion zone 50. When the length of rolled tobacco product 22 is inserted lighting end 27 first into segment 37A of channel 37 through inlet 38, it is moved through segment 37A of channel 37 toward igniter element 115 in the direction of arrowed line A until lighting end 27 of rolled tobacco product 22 directly abuttingly contacts or otherwise directly contacts or abuts against igniter element 115, which stops further movement of rolled tobacco product 22 and sets or otherwise locates lighting end 27 of rolled tobacco product 22 in combustion zone 50 of lighter assembly 20 in preparation for lighting through the application of lighting heat applied to combustion zone 50 from igniter element 115. And so igniter element 115 in combustion zone 50 of channel 37 is for interacting with lighting end 27 of rolled tobacco product 22 inserted lighting end 27 first into segment 37A of channel 37 through inlet 38 via a direct abutting contact of lighting end 27 of rolled tobacco product 22 against igniter element 115 for restricting movement rolled tobacco product 22 past igniter element 115 and into segment 37B of channel 37 from segment 37A of channel 37 so as to position or set lighting end 27 of rolled tobacco product 22 at combustion zone 50 along the side of igniter element 115 facing into segment 37A of channel 37 of lighter assembly 20 in preparation for lighting the lighting end 27 of rolled tobacco product 22 through the application of lighting heat applied to combustion zone 50 from igniter element 115. In lighter assembly 100, the application of lighting heat to combustion zone 50 for lighting the lighting end of a rolled tobacco product is provided by igniter element 115 of lighter assembly 100.

Segment 37B of channel 37 defines an airflow pathway from inlet 39 to combustion zone 50 for channeling a current of combustion air through segment 37B of channel 37 from inlet 39 to combustion zone 50 in the direction of arrowed line B in response to a presence of the lighting heat in combustion zone 50 from igniter element 115 to promote the lighting of lighting end 27 of rolled tobacco product 22 inserted into segment 37A of channel 37 through inlet 38 and received against igniter element 115 at combustion zone 50. The gases formed by the combustion of lighting end 27 of rolled tobacco product 22 by the heat generated by igniter element 115 in combustion zone 50, i.e., flue gases, are much hotter than the ambient outside air and therefore less dense than the ambient air. This causes combustion zone 50 to have a lower pressure than the pressure of the ambient air at inlet 39 to segment 37B of channel 37. This higher pressure of the ambient air at inlet 39 to segment 37B of channel 37 is a driving force that moves combustion air into and through segment 37B of channel 37 from inlet 39 to combustion zone 50 in the direction of arrowed line B to promote combustion of lighting end 27 of rolled tobacco product 22 applied to combustion zone 50 at segment 37A of channel 37, and also moves the resulting combustion flue gas up and out of segment 37A of channel 37 through rolled tobacco product 22 applied to segment 37A of channel 37 and inlet 38 in the direction of arrowed line B. With rolled tobacco product 22 applied to segment 37A of channel 37 during this lighting of lighting end 27, as it happens as soon as lighting end 27 of rolled tobacco product 22 is lighted sufficiently the smoke from the burning lighting end 27 is forced through rolled tobacco product 22 and escapes from the filtered end of rolled tobacco product 22 so as to indicate when rolled tobacco product 22 is lighted, whereupon button 113 is released so as to deactivate lighter 110 and rolled tobacco product 22 is pulled outwardly from segment 37A of channel 37 through inlet 38 in the direction of arrowed line B for smoking in the normal manner.

This movement or flow of combustion air and flue gases through channel 37 in the direction of arrowed line B in the lighting of rolled tobacco product 22 applied to combustion zone 50 via segment 37A of channel 37 is called natural draught/draft, natural ventilation, chimney effect, or stack effect. The lengths L1 and L2 of segments 37A and 37B of channel 37 and also the overall length of channel 37 between inlets 38 and 39 are chosen to produce this beneficial draught or draft. During the lighting of rolled tobacco product 22 applied to combustion zone 50 via segment 37A of channel 37, igniter element 115 in combustion zone 50 and lighting end 27 of rolled tobacco product 22 in combustion zone 50 are protectively enclosed in combustion zone 50 bound by elongated body 30 and are thereby protected or otherwise isolated from external influences, such as wind and rain, that could impede either the operation of igniter element 115 or the combustion of lighting end 27 of rolled tobacco product 22.

In lighter assembly 100, segments 37A and 37B of channel 37 are identical and relate to igniter element 115, combustion zone 50, and lighter 110 identically and operate in the same way in the lighting of a rolled tobacco product applied to combustion zone 50 via either segment 37A of channel 37 or segment 37B of channel 37 as in lighter assembly 20. In this way, a user need not have to concern himself as to which of the segments 37A and 37B of channel 37 to use in the lighting of a rolled tobacco product with lighter assembly 100 because they both are and function identically with respect to each other, in accordance with the principle of the invention.

To explain briefly the operation of segment 37B of lighter assembly 100, segment 37B of channel 37 is for the reception of a lighting end of a rolled tobacco product therein through inlet 38 and is considered to be, like segment 37A, another rolled tobacco product-receiving segment of channel 37. To light a rolled tobacco product through the use of segment 37B of channel 37, a length of roll of tobacco of a rolled tobacco product is inserted lighting end first into segment 37B of channel 37 through inlet 39 for lighting the lighting end of the rolled tobacco product through the application of lighting heat applied to combustion zone 50 by igniter element 115. When the length of the rolled tobacco product is inserted lighting end first into segment 37B of channel 37 through inlet 39, it is moved through segment 37B of channel 37 toward igniter element 115 in the direction of arrowed line B in FIG. 8 until the lighting end of the rolled tobacco product directly abuttingly contacts or otherwise directly contacts or abuts against igniter element 115, which stops further movement of the rolled tobacco product and sets or otherwise locates the lighting end of the rolled tobacco product in combustion zone 50 of lighter assembly 20 in preparation for lighting through the application of lighting heat applied to combustion zone 50 from igniter element 115. And so igniter element 115 in combustion zone 50 of channel 37 is for interacting with the lighting end of a rolled tobacco product inserted lighting end first into segment 37B of channel 37 through inlet 39 via a direct abutting contact of the lighting end of the rolled tobacco product against igniter element 115 for restricting movement the rolled tobacco product past igniter element 115 and into segment 37A of channel 37 from segment 37B of channel 37 so as to position or set the lighting end of the rolled tobacco product at combustion zone 50 along the side of igniter element 115 facing into segment 37B of channel 37 of lighter assembly 20 in preparation for lighting the lighting end of the rolled tobacco product through the application of lighting heat applied to combustion zone 50 from igniter element 115 of lighter 110 as explained above.

Segment 37A of channel 37 defines an airflow pathway from inlet 38 to combustion zone 50 for channeling a current of combustion air through segment 37A of channel 37 from inlet 38 to combustion zone 50 in the direction of arrowed line A in response to a presence of the lighting heat in combustion zone 50 from igniter element 115 formed by the activation of lighter 110 to promote the lighting of the lighting end of the rolled tobacco product inserted into segment 37B of channel 37 through inlet 39 and received against igniter element 115 at combustion zone 50. The gases formed by the combustion of the lighting end of the rolled tobacco product by the heat generated by igniter element 115 in combustion zone 50, i.e., flue gases, are much hotter than the ambient outside air and therefore less dense than the ambient air. This causes combustion zone 50 to have a lower pressure than the pressure of the ambient air at inlet 38 to segment 37A of channel 37. This higher pressure of the ambient air at inlet 38 to segment 37A of channel 37 is the driving force that moves combustion air into and through segment 37A of channel 37 from inlet 38 to combustion zone 50 in the direction of arrowed line A in FIG. 8 to promote combustion of the lighting end of rolled tobacco product 22 applied to combustion zone 50 at segment 37B of channel 37, and also moves the resulting combustion flue gas up and out of segment 37B of channel 37 through the rolled tobacco product applied to segment 37B of channel 37 and inlet 39 in the direction of arrowed line A. With the rolled tobacco product applied to segment 37B of channel 37 during this lighting of the lighting end of a rolled tobacco product applied to the combustion zone 50 via segment 37B of channel 37, as it happens as soon as the lighting end of the rolled tobacco product is lighted sufficiently the smoke from the burning lighting end of the rolled tobacco product is forced through the rolled tobacco product and escapes from the filtered end of the rolled tobacco product so as to indicate when the rolled tobacco product is lighted, whereupon button 113 is released so as to deactivate lighter 110 and rolled tobacco product 22 is pulled outwardly from segment 37B of channel 37 through inlet 39 in the direction of arrowed line A for smoking in the normal manner. This movement or flow of combustion air and flue gases through channel 37 in the direction of arrowed line A in the lighting of a rolled tobacco product applied to combustion zone 50 via segment 37B of channel 37 is called natural draught/draft, natural ventilation, chimney effect, or stack effect. Again, the lengths L1 and L2 of segments 37A and 37B of channel 37 and also the overall length of channel 37 between inlets 38 and 39 are chosen to produce this beneficial draught or draft. During the lighting of a rolled tobacco product applied to combustion zone 50 via segment 37B of channel 37, igniter element 115 and lighting end 27 of rolled tobacco product 22 in combustion zone 50 are protectively enclosed in combustion zone 50 bound by elongated body 30 and are thereby protected or otherwise isolated from external influences, such as wind and rain, that could impede either the formation of the lighting flame or the combustion of lighting end 27 of rolled tobacco product 22.

Figure 10:
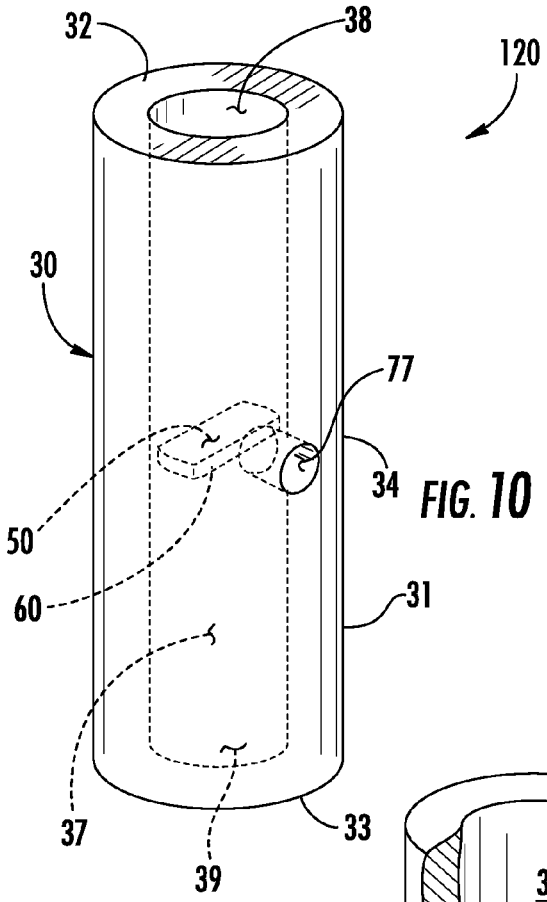
FIG. 10 is a perspective view of a lighter assembly constructed and arranged in accordance with yet still another embodiment of the invention with portions of the lighter assembly, including a channel and stop and portions of a match opening, being depicted schematically in phantom outline for illustration and reference.
Figure 11:
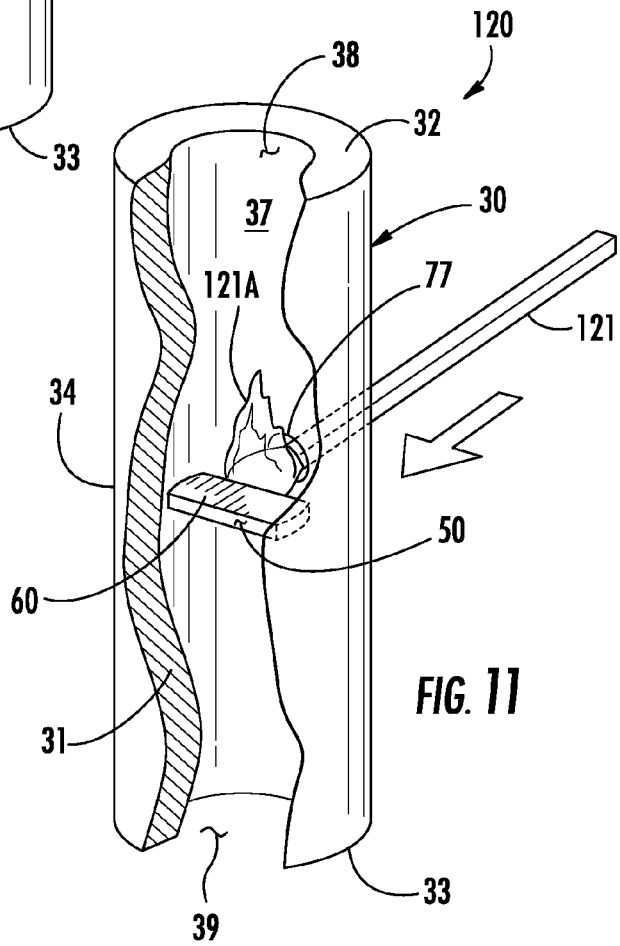
FIG. 11 is a perspective view of the lighter assembly of FIG. 10 with portions thereof broken away for illustrative purposes and further illustrating a lighted end of a match inserted into the channel of the lighter assembly through the match opening in preparation for lighting a rolled tobacco product, such as a cigarette.

In lighter assembly 20, the heat provided to combustion zone 50 is provided by a flame generated by lighter 70. FIGS. 10 and 11 illustrate an alternate embodiment of a lighter assembly denoted generally at 120 that is configured to be used with a lighted match 121 for providing the heat to combustion zone 50 of channel 37 by a flame 121A generated by lighted match 121 as shown in FIG. 11. In common with lighter assembly 20, lighter assembly 120 shares elongated body 30, including stop 60 and opening 77 that extends through continuous sidewall 31 from outer surface 35 to inner surface 36 at middle 34 of elongated body 30 and which faces or otherwise opposes combustion zone 50 and stop 60 as shown and discussed in detail above with the exception that, unlike lighter assembly 20, the only difference between lighter assembly 120 and lighter assembly 20 is that lighter assembly 120 is not formed with lighter 70 leaving opening 77 exposed and available to receive therethrough lighted match 121 for applying flame 121A of lighted match 121 to combustion zone 50 for lighting the lighting end of a rolled tobacco product applied to combustion zone 50. Match 121 is a conventional match being a slender piece of wood, cardboard, or other flammable material tipped with a chemical substance that produces fire when rubbed on a rough or chemically prepared surface in preparation for being applied lighted end first into combustion zone 50 through opening 77. And so in lighter assembly 120, opening 77 is considered a match opening, which extends through middle 34 of continuous sidewall 31 of elongated body 30 between the first and second inlets to the combustion zone and is for the introduction of lighted match 121 into combustion zone 50 from middle 34 of elongated body 30 for applying lighting heat to combustion zone 50 for lighting a lighting end of a rolled tobacco product applied to combustion zone 50. Other than the provision of opening 77 for the introduction of a lighted match therethrough and into combustion zone 50 for the lighting of a rolled tobacco product, lighter assembly 120 is identical in every respect to lighter assembly 20, and the discussion of lighter assembly 20 set forth above applies in every respect to lighter assembly 120.

Figure 12:
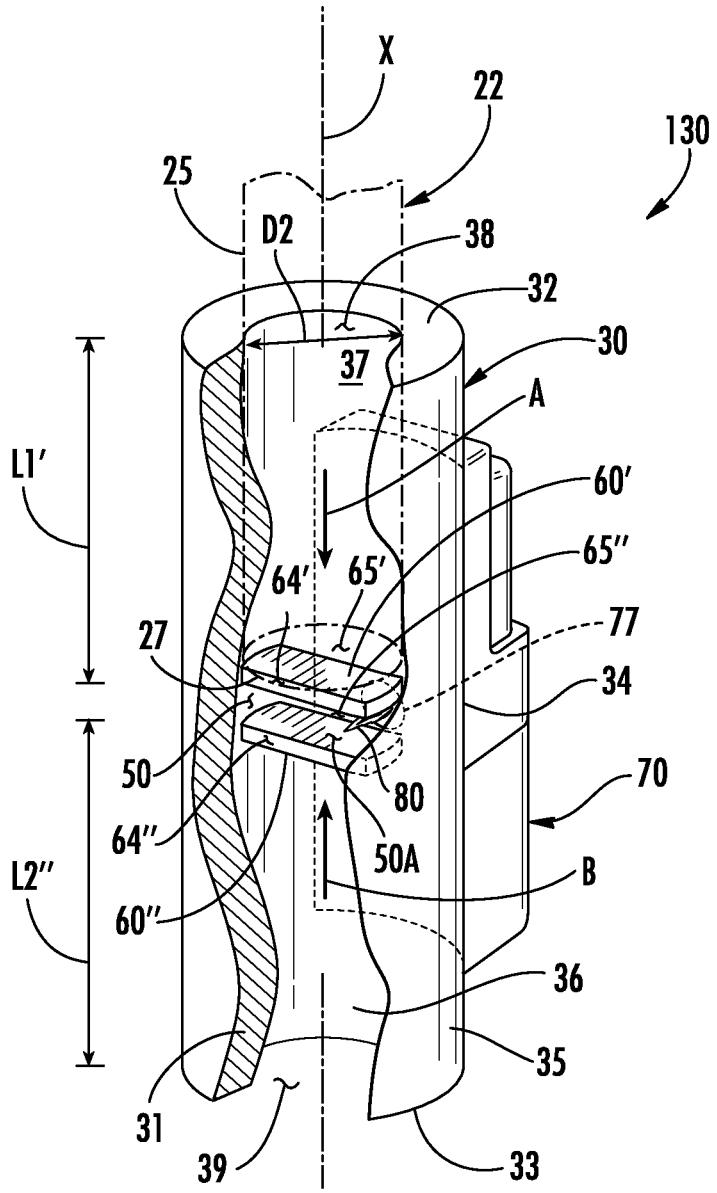
FIG. 12 is a perspective view of a lighter assembly constructed and arranged in accordance with still a further alternate embodiment of the invention.

Reference is now made to FIG. 12, which illustrates yet still another alternate embodiment of a lighter assembly denoted generally at 130 that, in common with lighter assembly 20, shares elongated body 30 including continuous sidewall 31, extremities 32 and 33, middle 34, opposed outer and inner surfaces 35 and 36, channel 37 having inner diameter D2, inlets 38 and 39, central axis X that extends centrally through channel 37 from inlet 38 to inlet 39 about which channel 37 and elongated body 30 are symmetrical, combustion zone 50, and lighter 70 including opening 77 for the nozzle (not shown in FIG. 12) of lighter 70 for the application of flame 80 to combustion zone 50 for rolled tobacco product-lighting purposes. Middle 34 of elongated body 30 is equidistant with respect to extremities 32 and 33, and the area of channel 37 at middle 34 of elongated body 30 is a combustion area or zone 50 of lighter assembly 130 where the lighting of the lighting end of a rolled tobacco product takes place through the application of lighting heat applied to combustion zone 50 in accordance with the principle of the invention. Lighter assembly 20 incorporates one stop 60, as disclosed in detail above. Lighter assembly 130, however, incorporates two such stops, one being denoted at 60', and the other being denoted at 60". With the exception of the specific positioning of stops in channel 37 at combustion zone 50, stops 60' and 60" are each structurally identical in every respect to stop 60.

Stops 60' and 60" are located in channel 37 at combustion zone 50 where a rolled tobacco product is to be lit and are diametrically opposed and are parallel with respect to each other, and are spaced apart so as to form or otherwise define a gap or space therebetween, which is a heat-receiving area or space of combustion zone 50 that is denoted at 50A. Heat-receiving area/space 50A is formed and defined between stops 60' and 60", and is part of combustion zone 50, and is the place where lighting heat is applied from lighter 70 for rolled tobacco product-lighting purposes. Moreover, heat-receiving space 50A of combustion zone 50 traverses the geometric center of channel 37 between inlets 38 and 39. The opening 77 from which comes flame 80 as generated by lighter 70 that provides the lighting heat for rolled tobacco product-lighting purposes is located between stops 60' and 60".

Stop 60' is located between, on the one hand, inlet 38 and, on the other hand, middle 34 along one side of heat-receiving space 50A of combustion zone 50. Stop 60" is spaced-apart from and opposes stop 60' and is located between, on the one hand, inlet 39 and, on the other hand, middle 34 along the opposed side of heat-receiving space 50A of combustion zone 50. This structure delineates or otherwise defines opposed segments 37A' and 37B' of channel 37 formed in elongated body 30 of lighter assembly 130. Segment 37A' of channel 37 is itself a channel or a channel portion in relation to channel 37 and extends from inlet 38 at extremity 32 of elongated body 30 to combustion zone 50 and stop 60' along one side of heat-receiving space 50A of combustion zone 50. Segment 37B' of channel 37 is itself a channel or channel portion in relation to channel 37 and extends from inlet 39 at extremity 33 of elongated body 30 to combustion zone 50 and stop 60" along the opposed side of heat-receiving space 50A, which is the side of heat-receiving space 50A the opposes the side of heat-receiving space 50A relating to stop 60'.

The entire length L1' of segment 37A' of channel 37 from inlet 38 at extremity 32 to stop 60' has inner diameter D2 that relates to, and that is somewhat greater than, diameter D1 of rolled tobacco product 22 illustrated in FIG. 1 so as to permit the reception of lighting end 27 of rolled tobacco product 22 into segment 37A' through inlet 38 without tearing or damaging the rolled tobacco product. The entire length L2' of segment 37B' of channel 37 from inlet 39 at extremity 32 to stop 60" has inner diameter D2 that relates to, and that is somewhat greater than, diameter D1 of rolled tobacco product 22 illustrated in FIG. 1 so as to permit the reception of lighting end 27 of rolled tobacco product 22 into segment 37B' through inlet 38 without tearing or damaging the rolled tobacco product. Segment 37A' of channel 37 is for the intake/reception therein through inlet 38 in the direction of arrowed line A in FIG. 12 of lighting end 27 of rolled tobacco product 22 to be lighted at combustion zone 50 through the application of lighting heat at heat-receiving space 50A of combustion zone 50 between stops 60' and 60" and is therefore considered to be one rolled tobacco product-receiving segment of channel 37 of lighter assembly 130. Segment 37B' of channel 37 is, likewise, for the intake/reception therein through inlet 39 in the direction of arrowed line B in FIG. 12 of lighting end 27 of rolled tobacco product 22 to be lighted at combustion zone 50 through the application of lighting heat at heat-receiving space 50A of combustion zone 50 between stops 60' and 60" and is therefore considered to be another rolled tobacco product-receiving segment of channel 37 of lighter assembly 130. Furthermore, segment 37A' of channel 37 is for the intake/reception therein through inlet 38 in the direction of arrowed line A in FIG. 12 of combustion air to stimulate the lighting of a lighting end of a rolled tobacco product applied into segment 37B' of channel 37, and segment 37B' of channel 37 is, likewise, for the intake/reception therein through inlet 39 in the direction of arrowed line B in FIG. 12 of combustion air to stimulate the lighting of a lighting end of a rolled tobacco product applied into segment 37A' of channel 37.

Segment 37A' of channel 37 has length L1' that extends from inlet 38 to stop 60' located along one side of heat-receiving space 50A of combustion zone 50, and segment 37B' of channel 37 has length L2 that extends from inlet 39 to stop 60" located along the opposing side of heat-receiving space 50A of combustion zone opposite to stop 60'. In this example, length L1' segment 37A' of channel 37 is equal to length L2' of segment 37B' of channel 37. In this example, lengths L1' and L2' of segments 37A' and 37B' of channel 37 are each approximately 20 mm in length. Stops 60' and 60" in combustion zone 50 are located between the opposed segments 37A' and 37B' and thus between the opposed lengths L1' and L2' of segments 37A' and 37B', and heat-receiving space 50A to receive flame 80 from lighter 70 that produces the lighting heat in combustion zone 50 at heat-receiving space 50A for rolled tobacco product-lighting purposes is located between the opposed stops 60' and 60".

As in lighter assembly 20, in lighter assembly 130 inlet 38 formed in extremity 32 of elongated body 30 is in-line and identical in size and shape with respect to opposing inlet 39 formed in extremity 33 of elongated body 30, and inlets 38 and 39 are coaxial in that they encircle and share axis X, which extends through the geometric center of inlets 38 and 39 about which inlets 38 and 39 are symmetrical. In other words, it will be understood that inlets 38 and 39 are the minor image opposites of one another Likewise, segment 37A' of channel 37 is in-line and identical in size and shape with respect to opposing segment 37B' of channel 37, and segments 37A' and 37B' of channel 37 are coaxial in that they encircle and share axis X, which extends through the geometric center of segments 37A' and 37B' of channel 37 about which segments 37A' and 37B' of channel 37 are symmetrical. In other words, it will be understood that segments 37A' and 37B' of channel 37 are the mirror image opposites of one another.

Looking momentarily to FIGS. 2 and 3 in relation to lighter assembly 20, there are opposed gaps 64 and 65 defined at combustion zone 50 between inner surface 36 of elongated body 30 and the corresponding sides 60C and 60D of stop 60, and that these gaps 64 and 65 are part of combustion zone 50 and traverse stop 60 from segment 37A of channel 37 to segment 37B of channel 37 so as to couple segment 37A of channel 37 in gaseous communication with segment 37B of channel 37 at combustion zone 50. Identically to that of stop 60 of lighter assembly 20, there are opposed such gaps 64' and 65' defined at combustion zone 50 between inner surface 36 of elongated body 30 and the opposed sides of stops 60', and there are likewise opposed such gaps 64" and 65" defined at combustion zone 50 between inner surface 36 of elongated body 30 and the opposed sides of stops 60". Gaps 64' and 65' relating to stop 60', and gaps 64" and 65" relating to stop 60" are part of combustion zone 50 of lighter assembly 130. Gaps 64' and 65' relating to stop 60' traverse stop 60' from segment 37A' of channel 37 hear-receiving space 50A, and gaps 64" and 65" relating to stop 60" traverse stop 60" from segment 37B' to heat-receiving space 50A. As such, combustion zone 50 traverses stops 60' and 60" from segment 37A' of channel 37 to heat-receiving space 50A and to segment 37B' of channel 37 so as to couple segment 37A' of channel in gaseous communication with segment 37B' of channel 37 at combustion zone 50.

As explained above, segment 37A' of channel 37 is for the reception of lighting end 27 of rolled tobacco product 22 therein through inlet 38 and is considered to be a rolled tobacco product-receiving segment of channel 37. To illustrate this, in FIG. 12 a length of roll of tobacco 25 of rolled tobacco product 22 as depicted in phantom outline and is shown as it would appear inserted lighting end 27 first into segment 37A' of channel 37 through inlet 38 for lighting the lighting end 27 of rolled tobacco product 22 through the application of lighting heat applied to heat-receiving space 50A of combustion zone 50 between stops 60' and 60". When the length of rolled tobacco product 22 is inserted lighting end 27 first into segment 37A' of channel 37 through inlet 38, it is moved through segment 37A' of channel 37 toward stop 60' in the direction of arrowed line A until lighting end 27 of rolled tobacco product 22 directly abuttingly contacts or otherwise directly contacts or abuts against stop 60', which stops further movement of rolled tobacco product 22 and sets or otherwise locates lighting end 27 of rolled tobacco product 22 in combustion zone 50 of lighter assembly 130 in preparation for lighting through the application of lighting heat applied to heat-receiving space 50A of combustion zone 50. And so stop 60' in combustion zone 50 of channel 37 is for interacting with lighting end 27 of rolled tobacco product 22 inserted lighting end 27 first into segment 37A' of channel 37 through inlet 38 via a direct abutting contact of lighting end 27 of rolled tobacco product 22 against stop 60' for restricting movement of rolled tobacco product 22 past stop 60' and into heat-receiving space 50A of combustion zone 50 of channel 37 from segment 37A' of channel 37 so as to position or set lighting end 27 of rolled tobacco product 22 at combustion zone 50 along one side of heat-receiving space 50A of combustion zone 50 and along the side of stop 60' facing into segment 37A' of channel 37 of lighter assembly 130 in preparation for lighting the lighting end 27 of rolled tobacco product 22 through the application of lighting heat applied to heat-receiving space 50A of combustion zone 50. Because stop 60' restricts movement of lighting end 27 of rolled tobacco product 22 past stop 60' and into heat-receiving space 50A of combustion zone 50 of channel 37 from segment 37A' of channel 37, lighting end 27 is held by stop 60' away from heat-receiving space 50A preventing flame 80 generated by lighter 70 from directly contacting lighting end 27 of rolled tobacco product 22 yet allowing enough heat from flame 80 to light lighting end 27 of rolled tobacco product 22 after about 4-7 seconds of holding rolled tobacco product 22 in place while activating lighter 70 to maintain flame 80. This process is a "toasting" process, whereby stop 60' holds lighting end 27 of rolled tobacco product 22 away from heat-receiving space 50A to prevent flame 80 generated by lighter 70 from directly contacting and burning lighting end 27 of rolled tobacco product 22 that could cause unnecessary charring of the rolled tobacco product and unwanted flavors in the resulting smoke, and yet holds lighting end 27 of rolled tobacco product 22 close enough to heat-receiving space 50A of combustion zone 50 to allow enough lighting heat from flame 80 to gently toast and light lighting end 27 of rolled tobacco product 22 after about 4-7 seconds of holding rolled tobacco product 22 in place while concurrently activating lighter 70 to maintain flame 80. Again, in lighter assembly 130 the application of lighting heat to heat-receiving space 50A of combustion zone 50 for lighting the lighting end of a rolled tobacco product is provided by lighter 70 of lighter assembly 130, the operation of which is discussed in detail in connection with lighter assembly 20 and will not be further discussed in connection with lighter assembly 130.

Segment 37B' of channel 37 defines an airflow pathway from inlet 39 to combustion zone 50 for channeling a current of combustion air through segment 37B' of channel 37 from inlet 39 to combustion zone 50 in the direction of arrowed line B in response to a presence of the lighting heat in heat-receiving space 50A of combustion zone 50 from flame 80 formed by lighter 70 to promote the lighting of lighting end 27 of rolled tobacco product 22 inserted into segment 37A' of channel 37 through inlet 38 and received against stop 60' at combustion zone 50. The gases formed by the combustion of the lighting fuel from the fuel canister part of lighter 70 in heat-receiving space 50A of combustion zone 50 via flame 80, i.e., flue gases, are much hotter than the ambient outside air and therefore less dense than the ambient air. This causes combustion zone 50 to have a lower pressure than the pressure of the ambient air at inlet 39 to segment 37B' of channel 37. This higher pressure of the ambient air at inlet 39 to segment 37B' of channel 37 is a driving force that moves combustion air into and through segment 37B' of channel 37 from inlet 39 to combustion zone 50 in the direction of arrowed line B in FIG. 12 to promote combustion of lighting end 27 of rolled tobacco product 22 applied to combustion zone 50 at segment 37A' of channel 37, and also moves the resulting combustion flue gas up and out of segment 37A' of channel 37 through rolled tobacco product 22 applied to segment 37A' of channel 37 and inlet 38 in the direction of arrowed line B. With rolled tobacco product 22 applied to segment 37A' of channel 37 during this lighting of lighting end 27, as it happens as soon as lighting end 27 of rolled tobacco product 22 is lighted sufficiently the smoke from the burning lighting end 27 is forced through rolled tobacco product 22 and escapes from the filtered end of rolled tobacco product 22 so as to indicate when rolled tobacco product 22 is lighted, whereupon lighter 70 is deactivated as explained in connection with the operation of lighter assembly 20 and rolled tobacco product 22 is pulled outwardly from segment 37A' of channel 37 through inlet 38 in the direction of arrowed line B for smoking in the normal manner. This movement or flow of combustion air and flue gases through channel 37 in the direction of arrowed line B in the lighting of rolled tobacco product 22 applied to combustion zone 50 via segment 37A' of channel 37 is called natural draught/draft, natural ventilation, chimney effect, or stack effect. The lengths L1' and L2' of segments 37A' and 37B' of channel 37 and also the overall length of channel 37 between inlets 38 and 39 are chosen to produce this beneficial draught or draft. During the lighting of rolled tobacco product 22 applied to combustion zone 50 via segment 37A' of channel 37, flame 80 in heat-receiving space 50A of combustion zone 50 and lighting end 27 of rolled tobacco product 22 in combustion zone 50 are protectively enclosed in combustion zone 50 bound by elongated body 30 and are thereby protected or otherwise isolated from external influences, such as wind and rain, that could impede either the formation of the lighting flame or the combustion of lighting end 27 of rolled tobacco product 22.

The discussion above explains in detail how segments 37A' and 37B' of channel 37 operate in the lighting of a rolled tobacco product applied to combustion zone 50 via segment 37A' of channel 37 of lighter assembly 130. Segments 37A' and 37B' of channel 37 are identical and relate to the corresponding stops 60' and 60", heat-receiving space 50A, combustion zone 50, and lighter 70 identically and operate in the same way in the lighting of a rolled tobacco product applied to combustion zone 50 via either segment 37A' of channel 37 or segment 37B' of channel 37 of lighter assembly 130. In this way, a user need not have to concern himself as to which of the segments 37A' and 37B' of channel 37 to use in the lighting of a rolled tobacco product because they both are and function identically with respect to each other, in accordance with the principle of the invention.

To explain briefly the operation of segment 37B' of lighter assembly 130, segment 37B' of channel 37 is for the reception of a lighting end of a rolled tobacco product therein through inlet 39 and is considered to be, like segment 37A', another rolled tobacco product-receiving segment of channel 37. To light a rolled tobacco product through the use of segment 37B' of channel 37, a length of a roll of tobacco of a rolled tobacco product is inserted lighting end first into segment 37B' of channel 37 through inlet 39 for lighting the lighting end of the rolled tobacco product through the application of lighting heat applied to heat-receiving space 50A of combustion zone 50. When the length of the rolled tobacco product is inserted lighting end first into segment 37B' of channel 37 through inlet 39, it is moved through segment 37B' of channel 37 toward stop 60 in the direction of arrowed line B in FIG. 12 until the lighting end of the rolled tobacco product directly abuttingly contacts or otherwise directly contacts or abuts against stop 60", which stops further movement of the rolled tobacco product and sets or otherwise locates the lighting end of the rolled tobacco product in combustion zone 50 of lighter assembly 130 in preparation for lighting through the application of lighting heat applied to heat-receiving space 50A of combustion zone 50. And so stop 60" in combustion zone 50 of channel 37 is for interacting with the lighting end of a rolled tobacco product inserted lighting end first into segment 37B' of channel 37 through inlet 39 via a direct abutting contact of the lighting end of the rolled tobacco product against stop 60" for restricting movement of the rolled tobacco product past stop 60" and into heat-receiving space 50A of combustion zone 50 of channel 37 from segment 37B' of channel 37 so as to position or set lighting end 27 of rolled tobacco product 22 at combustion zone 50 along the opposed side of heat-receiving space 50A of combustion zone 50 and along the side of stop 60" facing into segment 37B' of channel 37 of lighter assembly 130 in preparation for lighting the lighting end of a rolled tobacco product through the application of lighting heat applied to heat-receiving space 50A of combustion zone 50. Because stop 60" restricts movement of the lighting end of a rolled tobacco product past stop 60" and into heat-receiving space 50A of combustion zone 50 of channel 37 from segment 37B' of channel 37, the lighting end of the rolled tobacco product is held by stop 60" away from heat-receiving space 50A preventing flame 80 generated by lighter 70 from directly contacting the lighting end of the rolled tobacco product yet allowing enough heat from flame 80 to light the lighting end of the rolled tobacco product after about 4-7 seconds of holding rolled tobacco product 22 in place while activating lighter 70 to maintain flame 80. Again, this process is a "toasting" process, whereby stop 60" holds the lighting end of the rolled tobacco product away from heat-receiving space 50A to prevent flame 80 generated by lighter 70 from directly contacting and burning the lighting end of the rolled tobacco product 22 applied to segment 37B' that could cause unnecessary charring of the rolled tobacco product and unwanted flavors in the resulting smoke, and yet holds the lighting end of the rolled tobacco product 22 close enough to heat-receiving space 50A of combustion zone 50 to allow enough heat from flame 80 to gently toast and light the lighting end of the rolled tobacco product after about 4-7 seconds of holding the rolled tobacco product in place while concurrently activating lighter 70 to maintain flame 80. Again, in lighter assembly 130 the application of lighting heat to heat-receiving space 50A of combustion zone 50 for lighting the lighting end of a rolled tobacco product is provided by lighter 70 of lighter assembly 130, the operation of which is discussed in detail in connection with lighter assembly 20 and will not be further discussed in connection with lighter assembly 130.

Segment 37A' of channel 37 defines an airflow pathway from inlet 38 to combustion zone 50 for channeling a current of combustion air through segment 37A' of channel 37 from inlet 38 to combustion zone 50 in the direction of arrowed line A in response to a presence of the lighting heat in heat-receiving space 50A of combustion zone 50 from flame 80 formed by the activation of lighter 70 to promote the lighting of the lighting end of the rolled tobacco product inserted into segment 37B' of channel 37 through inlet 39 and received against stop 60" at combustion zone 50. The gases formed by the combustion of the lighting fuel from the fuel canister part of lighter 70 in combustion zone 50 via flame 80, i.e., flue gases, are much hotter than the ambient outside air and therefore less dense than the ambient air. This causes combustion zone 50 to have a lower pressure than the pressure of the ambient air at inlet 38 to segment 37A' of channel 37. This higher pressure of the ambient air at inlet 38 to segment 37A' of channel 37 is the driving force that moves combustion air into and through segment 37A' of channel 37 from inlet 38 to combustion zone 50 in the direction of arrowed line A in FIG. 12 to promote combustion of the lighting end of rolled tobacco product applied to combustion zone 50 at segment 37B' of channel 37, and also moves the resulting combustion flue gas up and out of segment 37B' of channel 37 through the rolled tobacco product applied to segment 37B' of channel 37 and inlet 39 in the direction of arrowed line A. With the rolled tobacco product applied to segment 37B' of channel 37 during this lighting of the lighting end of a rolled tobacco product applied to the combustion zone 50 via segment 37B' of channel 37, as it happens as soon as the lighting end of the rolled tobacco product is lighted sufficiently the smoke from the burning lighting end of the rolled tobacco product is forced through the rolled tobacco product and escapes from the filtered end of the rolled tobacco product so as to indicate when the rolled tobacco product is lighted, whereupon lighter 70 is deactivated to extinguish the flame and the rolled tobacco product is pulled outwardly from segment 37B' of channel 37 through inlet 39 in the direction of arrowed line A for smoking in the normal manner. This movement or flow of combustion air and flue gases through channel 37 in the direction of arrowed line A in the lighting of a rolled tobacco product applied to combustion zone 50 via segment 37B' of channel 37 is called natural draught/draft, natural ventilation, chimney effect, or stack effect. Again, the lengths L1 and L2 of segments 37A' and 37B' of channel 37 and also the overall length of channel 37 between inlets 38 and 39 are chosen to produce this beneficial draught or draft. During the lighting of a rolled tobacco product applied to combustion zone 50 via segment 37B' of channel 37, the flame in heat-receiving space 50A of combustion zone 50 provided by lighter 70 and lighting end 27 of rolled tobacco product 22 in combustion zone 50 are protectively enclosed in combustion zone 50 bound by elongated body 30 and are thereby protected or otherwise isolated from external influences, such as wind and rain, that could impede either the formation of the lighting flame or the combustion of lighting end 27 of rolled tobacco product 22.

The invention has been described above with reference to preferred embodiments. However, those skilled in the art will recognize that changes and modifications may be made to the embodiments without departing from the nature and scope of the invention. For instance, all or portions of continuous sidewall 31 of elongated body 30 of the various embodiments may be transparent so as to permit a visual observation of combustion zone 50 so as to permit one to observe the lighting of a rolled tobacco product at combustion zone 50. Furthermore, in lighter assembly 120 outer surface 35 of elongated body 31 may be configured as of with a roughened area to permit the striking of matches for lighting. In the various embodiments of the invention the inner diameter D2 of segment 37A of channel 37 is identical to the inner diameter D2 of segment 37B of channel 37, and in an alternate embodiments the inner diameters of segments 37A and 37B of channel 37 may be different, if so desired, so as to relate to and facilitate the reception of rolled tobacco products of varying diameters according to the principle of the invention. In regards to lighter assembly 130, the inner diameter D2 of segment 37A' of channel 37 is identical to the inner diameter D2 of segment 37B' of channel 37, and in an alternate embodiments the inner diameters of segments 37A' and 37B' of channel 37 may be different, if so desired, so as to relate to and facilitate the reception of rolled tobacco products of varying diameters according to the principle of the invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A portable, handheld lighter assembly for lighting a lighting end of a rolled tobacco product, such as a cigarette or a cigar, comprising:

an elongated body;

a channel extends through the elongated body from a first inlet of the elongated body to an opposed second inlet of the elongated body;

a stop is coupled to the elongated body and is positioned in a combustion zone of the channel between the first and second inlets so as to define a first segment of the channel for the reception of a lighting end of a rolled tobacco product therein through the first inlet and an opposed second segment of the channel, the first segment of the channel extends from the first inlet to the combustion zone and the stop, and the second segment of the channel extends from the second inlet to the combustion zone and the stop;

the stop for interacting with a lighting end of a rolled tobacco product inserted into the first segment of the channel through the first inlet for restricting movement the rolled tobacco product into the second segment of the channel from the first segment of the channel;

the combustion zone traverses the stop from the first segment of the channel to the second segment of the channel so as to couple the first segment of the channel in gaseous communication with the second segment of the channel at the combustion zone;

a lighter is coupled to the elongated body and is operable for applying lighting heat to the combustion zone for lighting a lighting end of a rolled tobacco product;

the second segment of the channel defines an airflow pathway that extends from the second inlet to the combustion zone for channeling a current of combustion air through the second segment of the channel from the second inlet to the combustion zone in response to a presence of lighting heat in the combustion zone from the lighter to light a lighting end of a rolled tobacco product inserted into the first segment of the channel through the first inlet and received against the stop at the combustion zone;

the stop is equidistant with respect to the first and second inlets of the elongated body;

the first segment of the channel has a first length extending from the first inlet to the stop;

the second segment of the channel has a second length extending from the second inlet to the stop; and the first length of the first segment of the channel is equal to the second length of the second segment of the channel.

2. The portable, handheld lighter assembly according to claim 1, wherein the first inlet is in-line with respect to the second inlet, and the first and second segments of the channel are coaxial.

3. The portable, handheld lighter assembly according to claim 2, wherein the lighter is a flame lighter and the lighting heat is flame lighting heat.

4. The portable, handheld lighter assembly according to claim 3, further comprising a nozzle structure formed in the elongated body proximate to the combustion zone, the nozzle structure being coupled between the flame lighter and the combustion zone so as to receive flame lighting heat from the flame lighter and diffuse the flame lighting heat into the combustion zone from many directions.

5. A portable, handheld lighter assembly for lighting a lighting end of a rolled tobacco product, such as a cigarette or a cigar, comprising:

an elongated body;

a channel extends through the elongated body from a first inlet of the elongated body to an opposed second inlet of the elongated body;

an electric lighter is coupled to the elongated body, the electric lighter includes an igniter element positioned in a combustion zone of the channel between the first and second inlets so as to define a first segment of the channel for the reception of a lighting end of a rolled tobacco product therein through the first inlet and an opposed second segment of the channel, the first segment of the channel extends from the first inlet to the combustion zone and the igniter element, and the second segment of the channel extends from the second inlet to the combustion zone and the igniter element;

the igniter element for interacting with a lighting end of a rolled tobacco product inserted into the first segment of the channel through the first inlet for restricting movement of the rolled tobacco product into the second segment of the channel from the first segment of the channel;

the combustion zone traverses the igniter element from the first segment of the channel to the second segment of the channel so as to couple the first segment of the channel in gaseous communication with the second segment of the channel at the combustion zone;

the electric lighter is operable for applying lighting heat to the combustion zone from the igniter element for lighting a lighting end of a rolled tobacco product;

the second segment of the channel defines an airflow pathway that extends from the second inlet to the combustion zone for channeling a current of combustion air through the second segment of the channel from the second inlet to the combustion zone in response to a presence of lighting heat in the combustion zone from the igniter element of the electric lighter to light a lighting end of a rolled tobacco product inserted into the first segment of the channel through the first inlet and received against the igniter element at the combustion zone;

the igniter element is equidistant with respect to the first and second inlets of the elongated body;

the first segment of the channel has a first length extending from the first inlet to the igniter element;

the second segment of the channel has a second length extending from the second inlet to the igniter element; and the first length of the first segment of the channel is equal to the second length of the second segment of the channel.

6. The portable, handheld lighter assembly according to claim 5, wherein the first inlet is in-line with respect to the second inlet, and the first and second segments of the channel are coaxial.

7. A portable, handheld lighter assembly for lighting a lighting end of a rolled tobacco product, such as a cigarette or a cigar, comprising:

an elongated body;

a channel extends through the elongated body from a first inlet of the elongated body to an opposed second inlet of the elongated body;

a stop is coupled to the elongated body and is positioned in a combustion zone of the channel between the first and second inlets so as to define a first segment of the channel for the reception of a lighting end of a rolled tobacco product therein through the first inlet and an opposed second segment of the channel for the reception of a lighting end of a rolled tobacco product therein through the second inlet, the first segment of the channel extends from the first inlet to the combustion zone and the stop, and the second segment of the channel extends from the second inlet to the combustion zone and the stop;

the stop for interacting with a lighting end of a rolled tobacco product inserted into the first segment of the channel through the first inlet for restricting movement of the rolled tobacco product into the second segment of the channel from the first segment of the channel, and for interacting with a lighting end of a rolled tobacco product inserted into the second segment of the channel through the second inlet for restricting movement of the rolled tobacco product into the first segment of the channel from the second segment of the channel;

the combustion zone traverses the stop from the first segment of the channel to the second segment of the channel so as to couple the first segment of the channel in gaseous communication with the second segment of the channel at the combustion zone;

a lighter is coupled to the elongated body and is operable for applying lighting heat to the combustion zone for lighting a lighting end of a rolled tobacco product;

the first segment of the channel defines a first airflow pathway that extends from the first inlet to the combustion zone for channeling a current of combustion air through the first segment of the channel from the first inlet to the combustion zone in response to a presence of lighting heat in the combustion zone from the lighter to light a lighting end of a rolled tobacco product inserted into the second segment of the channel through the second inlet and received against the stop at the combustion zone; and the second segment of the channel defines a second airflow pathway that extends from the second inlet to the combustion zone for channeling a current of combustion air through the second segment of the channel from the second inlet to the combustion zone in response to a presence of lighting heat in the combustion zone from the lighter to light a lighting end of a rolled tobacco product inserted into the first segment of the channel through the first inlet and received against the stop at the combustion zone.

8. The portable, handheld lighter assembly according to claim 7, further comprising:

the stop is equidistant with respect to the first and second inlets of the elongated body;

the first segment of the channel has a first length extending from the first inlet to the stop;

the second segment of the channel has a second length extending from the second inlet to the stop; and the first length of the first segment of the channel is equal to the second length of the second segment of the channel.

9. The portable, handheld lighter assembly according to claim 8, wherein the first inlet is in-line with respect to the second inlet, and the first and second segments of the channel are coaxial and identical with respect to each other.

10. The portable, handheld lighter assembly according to claim 9, wherein the lighter is a flame lighter and the lighting heat is flame lighting heat.

11. The portable, handheld lighter assembly according to claim 10, further comprising a nozzle structure formed in the elongated body proximate to the combustion zone, the nozzle structure being coupled between the flame lighter and the combustion zone so as to receive flame lighting heat from the flame lighter and diffuse the flame lighting heat into the combustion zone from many directions.

12. A portable, handheld lighter assembly for lighting a lighting end of a rolled tobacco product, such as a cigarette or a cigar, comprising:

an elongated body;

a channel extends through the elongated body from a first inlet of the elongated body to an opposed second inlet of the elongated body;

an electric lighter is coupled to the elongated body, the electric lighter includes an igniter element positioned in a combustion zone of the channel between the first and second inlets so as to define a first segment of the channel for the reception of a lighting end of rolled tobacco product therein through the first inlet and an opposed second segment of the channel for the reception of a lighting end of a rolled tobacco product therein through the second inlet, the first segment of the channel extends from the first inlet to the combustion zone and the igniter element, and the second segment of the channel extends from the second inlet to the combustion zone and the igniter element;

the igniter element for interacting with a lighting end of a rolled tobacco product inserted into the first segment of the channel through the first inlet for restricting movement of the rolled tobacco product into the second segment of the channel from the first segment of the channel, and for interacting with a lighting end of a rolled tobacco product inserted into the second segment of the channel through the second inlet for restricting movement of the rolled tobacco product into the first segment of the channel from the second segment of the channel;

the combustion zone traverses the igniter element from the first segment of the channel to the second segment of the channel so as to couple the first segment of the channel in gaseous communication with the second segment of the channel at the combustion zone;

the electric lighter is operable for applying lighting heat to the combustion zone from the igniter element for lighting a lighting end of a rolled tobacco product;

the first segment of the channel defines a first airflow pathway that extends from the first inlet to the combustion zone for directing a current of combustion air through the first segment of the channel from the first inlet to the combustion zone in response to a presence of lighting heat in the combustion zone from the igniter element of the electric lighter to light a lighting end of a rolled tobacco product inserted into the second segment of the channel through the second inlet and received against the igniter element at the combustion zone; and the second segment of the channel defines a second airflow pathway that extends from the second inlet to the combustion zone for directing a current of combustion air through the second segment of the channel from the second inlet to the combustion zone in response to a presence of lighting heat in the combustion zone from the igniter element of the electric lighter to light a lighting end of a rolled tobacco product inserted into the first segment of the channel through the first inlet and received against the igniter element at the combustion zone.

13. The portable, handheld lighter assembly according to claim 12, further comprising:

the igniter element is equidistant with respect to the first and second inlets of the elongated body;

the first segment of the channel has a first length extending from the first inlet to the igniter element;

the second segment of the channel has a second length extending from the second inlet to the igniter element; and the first length of the first segment of the channel is equal to the second length of the second segment of the channel.

14. The portable, handheld lighter assembly according to claim 13, wherein the first inlet is in-line with respect to the second inlet, and the first and second segments of the channel are coaxial and identical with respect to each other.

15. A portable, handheld lighter assembly for lighting a lighting end of a rolled tobacco product, such as a cigarette or a cigar, comprising:

an elongated body;

a channel extends through the elongated body from a first inlet of the elongated body to an opposed second inlet of the elongated body;

opposed first and second stops are coupled to the elongated body and are positioned in a combustion zone of the channel between the first and second inlets so as to define a first segment of the channel for the reception of a lighting end of a rolled tobacco product therein through the first inlet and an opposed second segment of the channel for the reception of a lighting end of a rolled tobacco product therein through the second inlet, and a heat-receiving space of the combustion zone between the first and second stops, wherein the first segment of the channel extends from the first inlet to the combustion zone and the first stop, and the second segment of the channel extends from the second inlet to the combustion zone and the second stop;

a lighter is coupled to the elongated body and is operable for applying lighting heat to the heat-receiving space of the combustion zone for lighting a lighting end of a rolled tobacco product;

the first stop is for interacting with a lighting end of a rolled tobacco product inserted into the first segment of the channel through the first inlet for restricting movement of the rolled tobacco product into the heat-receiving space of the combustion zone from the first segment of the channel;

the second stop is for interacting with a lighting end of a rolled tobacco product inserted into the second segment of the channel through the second inlet for restricting movement of the rolled tobacco product into the heat-receiving space of the combustion zone from the second segment of the channel;

the combustion zone traverses the first and second stops from the first segment of the channel to the heat-receiving space and to the second segment of the channel so as to couple the first segment of the channel in gaseous communication with the second segment of the channel at the combustion zone;

the first segment of the channel defines a first airflow pathway that extends from the first inlet to the combustion zone for channeling a current of combustion air through the first segment of the channel from the first inlet to the combustion zone in response to a presence of lighting heat in the heat-receiving space of the combustion zone from the lighter to light a lighting end of a rolled tobacco product inserted into the second segment of the channel through the second inlet and received against the second stop at the combustion zone; and the second segment of the channel defines a second airflow pathway that extends from the second inlet to the combustion zone for channeling a current of combustion air through the second segment of the channel from the second inlet to the combustion zone in response to a presence of lighting heat in the heat-receiving space of the combustion zone from the lighter to light a lighting end of a rolled tobacco product inserted into the first segment of the channel through the first inlet and received against the first stop at the combustion zone.

16. The portable, handheld lighter assembly according to claim 15, further comprising:

the first segment of the channel has a first length extending from the first inlet to the first stop;

the second segment of the channel has a second length extending from the second inlet to the second stop; and the first length of the first segment of the channel is equal to the second length of the second segment of the channel.

17. The portable, handheld lighter assembly according to claim 16, wherein the first inlet is in-line with respect to the second inlet, and the first and second segments of the channel are coaxial and identical with respect to each other.

18. The portable, handheld lighter assembly according to claim 15, wherein the lighter is a flame lighter and the lighting heat is flame lighting heat.

* * * * *